US008573614B2

(12) United States Patent
Duarte et al.

(10) Patent No.: US 8,573,614 B2
(45) Date of Patent: Nov. 5, 2013

(54) SINGLE FOOT SKATE

(75) Inventors: Luis Miguel Duarte, Toronto (CA); Daniel David Karmazyn, Thornhill (CA)

(73) Assignee: Luis Miguel Duarte (CA)

( * ) Notice: Subject to any disclaimer, the term of this patent is extended or adjusted under 35 U.S.C. 154(b) by 839 days.

(21) Appl. No.: 12/595,813

(22) PCT Filed: Aug. 14, 2007

(86) PCT No.: PCT/CA2007/001395

§ 371 (c)(1), (2), (4) Date: Feb. 16, 2010

(87) PCT Pub. No.: WO2008/019482

PCT Pub. Date: Feb. 21, 2008

(65) Prior Publication Data

US 2010/0289230 A1 Nov. 18, 2010

Related U.S. Application Data

(60) Provisional application No. 60/837,223, filed on Aug. 14, 2006.

(30) Foreign Application Priority Data

Nov. 15, 2006 (CA) ..... 2569421

(51) Int. Cl.

| | |
|---|---|
| ***A63C 17/00*** | (2006.01) |
| ***A63C 17/14*** | (2006.01) |
| ***A63C 17/26*** | (2006.01) |

(52) U.S. Cl.

CPC ..... *A63C 17/262* (2013.01); *A63C 17/1436* (2013.01)

USPC ..... 280/87.041; 280/11.208; 280/607

(58) Field of Classification Search

USPC ..... 280/11.19, 11.204, 11.207–11.209, 280/11.27, 11.214, 11.216, 11.3, 11.31, 280/87.041, 87.042, 87.05, 809, 811, 816, 280/842; D21/763–765

See application file for complete search history.

(56) References Cited

U.S. PATENT DOCUMENTS

| | | | | | |
|---|---|---|---|---|---|
| 322,173 | A | * | 7/1885 | Geran | 280/11.208 |
| 805,942 | A | * | 11/1905 | Beals | 280/11.208 |
| 2,191,018 | A | * | 2/1940 | Ickenroth | 280/11.208 |
| 2,315,342 | A | * | 3/1943 | Lieberman | 280/11.209 |
| 2,566,747 | A | * | 9/1951 | Rice | 280/11.209 |
| D232,110 | S | * | 7/1974 | Krause | D21/763 |

(Continued)

FOREIGN PATENT DOCUMENTS

EP 0 846 480 A2 6/1998

*Primary Examiner* — Paul N Dickson
*Assistant Examiner* — Wesley Potter
(74) *Attorney, Agent, or Firm* — Harness, Dickey & Pierce, P.L.C.

(57) ABSTRACT

A skate including a main body, a plurality of wheels, a primary foot support, a sidewall, and a foot rest. The plurality of wheels are rotatably coupled to the main body. The primary foot support is configured to support a skater's first foot. The sidewall projects above the primary foot support. The foot rest extends from the sidewall to support a skater's second foot. The foot rest includes a first portion extending rearward relative to the primary foot support, and a second portion extending laterally relative to the primary foot support. The skater's second foot can be positioned upon and simultaneously supported by both the first portion and the second portion of the foot rest.

40 Claims, 30 Drawing Sheets

(56) References Cited

U.S. PATENT DOCUMENTS

| | | | | |
|---|---|---|---|---|
| 3,993,318 | A | 11/1976 | Rothmayer | |
| 4,022,482 | A * | 5/1977 | Powell | 280/809 |
| 4,537,419 | A * | 8/1985 | Kiernan | 280/607 |
| 5,954,366 | A | 9/1999 | Forman | |
| D473,906 | S * | 4/2003 | Schmid | D21/765 |
| 6,688,613 | B1 | 2/2004 | Malloy | |
| 6,719,304 | B2 * | 4/2004 | Miller et al. | 280/11.27 |
| D530,765 | S * | 10/2006 | Rojas | D21/760 |
| 7,150,461 | B2 * | 12/2006 | Schnuckle et al. | 280/87.05 |
| 7,201,387 | B2 * | 4/2007 | Seta | 280/87.05 |
| 2002/0105152 | A1 * | 8/2002 | Miller | 280/11.231 |
| 2003/0214109 | A1 * | 11/2003 | Hedeen, Jr. | 280/87.042 |
| 2004/0021282 | A1 * | 2/2004 | Grattini | 280/87.042 |
| 2006/0055136 | A1 * | 3/2006 | Seta | 280/87.05 |

* cited by examiner

FIG. 5A
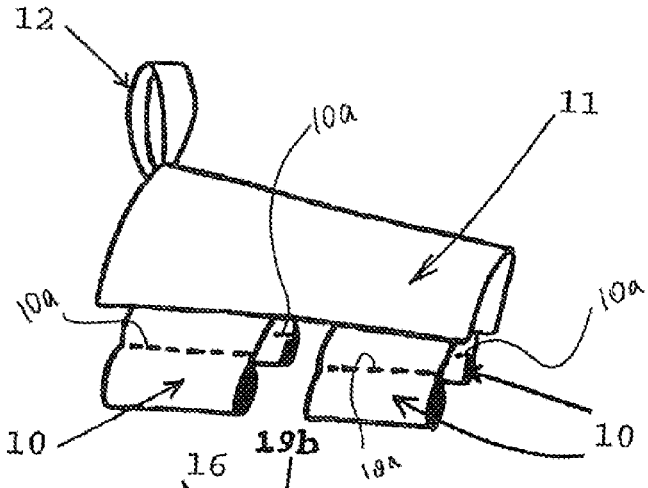
FIG. 5B
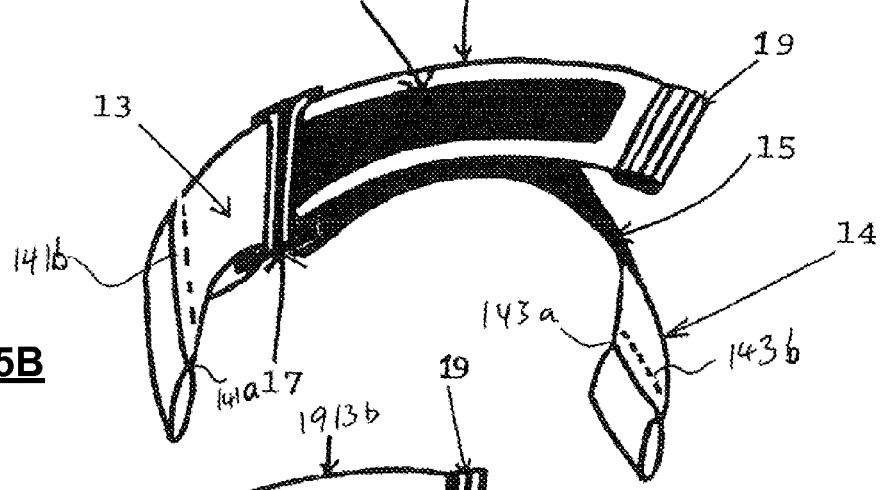
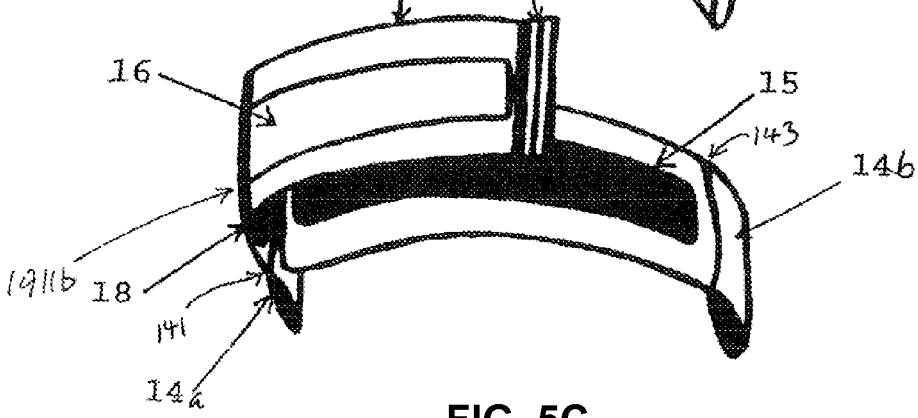
FIG. 5C

Front View

Back View

SINGLE FOOT SKATE

FIELD OF INVENTION

This invention relates to wheeled skating devices.

BACKGROUND OF THE INVENTION

Existing skate devices, available in forms such as roller skates, in-line skates and skateboards, are widely available for the use and enjoyment of skaters for rolling travel across various terrain. Although various forms of skate devices have been accepted by the skating community, existing skate devices are hindered by certain undesirable characteristics which render their use to be less than optimal. For example, roller skates, in-line skates, and skateboards, generally, position the skater at a relatively high vertical distance above the ground, thereby making it relatively difficult for a skater to balance him or herself and to control travel. In this respect, in order to competently use these skate devices, significant practice is required to develop the necessary balancing and riding skills. As well, with most roller skates and in-line skates, it is necessary for the skater to remove his or her street shoes in order to use these devices. With skateboards, although the skater does not remove his or her street shoes, when riding the skateboard, the skater is positioned sideways relative to the direction of travel, which makes it more difficult for the skater to see where he or she is travelling.

SUMMARY OF THE INVENTION

In one aspect, there is provided a skate comprising:

a frame;

a plurality of wheels rotatably coupled to the frame and configured to effect rolling motion of the skate across a reaction surface;

a foot support coupled to the frame, and including an operative foot support surface configured for supporting a skater's first foot, wherein the operative foot support surface includes a longitudinal axis;

a foot coupling unit coupled to the frame, and configured for coupling a skater's first foot to the operative foot support surface; and a foot rest extending from the frame, and including an operative foot rest support surface configured for supporting the skater's second foot when the skater's first foot is supported by and coupled to the operative foot support surface;

wherein the operative foot rest support surface includes a minimum linear width of at least 30 millimeters and also includes a maximum linear width of less than 45 millimeters, and wherein each of the minimum width and the maximum width is measured along a plane to which the longitudinal axis is normal.

In another aspect, there is provided a skate comprising:

a frame;

a plurality of wheels rotatably coupled to the frame and configured to effect rolling motion of the skate across a reaction surface;

a foot support coupled to the frame, and including an operative foot support surface configured for supporting a skater's first foot, wherein the operative foot support surface includes a longitudinal axis;

a foot coupling unit coupled to the frame, and configured for coupling a skater's first foot to the operative foot support surface; and a foot rest extending from the frame, and including an operative foot rest support surface configured for supporting the skater's second foot when the skater's first foot is supported by and coupled to the operative foot support surface;

wherein the maximum horizontal distance between the longitudinal axis and an outermost edge of the foot rest is less than 140 millimeters, and wherein the maximum horizontal distance is measured along a plane to which the longitudinal axis is normal.

In another aspect, there is provided a skate comprising:

a frame;

a plurality of wheels rotatably coupled to the frame;

a foot support coupled to the frame, and configured for supporting a skater's first foot;

a foot coupling unit coupled to the frame, and configured for coupling the skater's first foot to the foot support;

a lateral foot rest extending from the frame, and disposed laterally relative to the foot support; and a rear foot rest extending from the frame, and disposed rearwardly relative to the foot support;

wherein the lateral foot rest and the rear foot rest are disposed relative to one another such that, when the skater's first foot is supported by and coupled to the foot support, the skater's second foot can be positioned upon and be simultaneously supported by both the lateral foot rest and the rear foot rest.

In another aspect, there is provided a skate comprising:

a frame;

a plurality of wheels rotatably coupled to the frame and configured to effect rolling motion of the skate across a reaction surface;

a foot support coupled to the frame, and including an operative foot support surface configured for supporting a skater's first foot a foot coupling unit coupled to the frame, and configured for coupling the skater's first foot to the operative foot support surface; and a foot rest extending from the frame, and disposed laterally relative to the operative foot support surface, and including an operative foot rest support surface configured for supporting the skater's second foot when the skater's first foot is supported by and coupled to the foot support;

wherein the operative foot rest support surface includes a minimum angle of inclination above a horizontal plane of at least 10 degrees relative to the horizontal plane, and also includes a maximum angle of inclination above a horizontal plane of less than 18 degrees relative to the horizontal plane.

In another aspect, there is provided a skate comprising:

a frame;

a plurality of wheels rotatably coupled to the frame;

a foot support coupled to the frame, and configured for supporting a skater's foot;

a foot coupling unit coupled to the frame, and configured for coupling the skater's foot to the foot support; and a brake coupled to either a front end of the frame or a rear end of the frame, and including a braking surface, wherein the braking surface includes a minimum width of at least 80 millimeters measured along a horizontal plane.

In another aspect, there is provided a skate comprising:

a frame;

a plurality of wheels rotatably coupled to the frame;

a foot support coupled to the frame, and configured for supporting a skater's foot;

a foot coupling unit coupled to the frame, and configured for coupling the skater's foot; and a brake coupled to either a front end of the frame or a rear end of the frame, wherein the brake is disposed within a recess provided within the frame end to which the brake is coupled.

In another aspect, there is provided a skate comprising:

a frame;

a plurality of wheels rotatably coupled to the frame;

a foot support coupled to the frame, and configured for supporting a skater's foot;

a foot coupling unit coupled to the frame, and configured for coupling the skater's foot; and a brake coupled to either a front end of the frame or a rear end of the frame, and including a braking surface including two oppositely disposed lower edges, wherein each of the oppositely disposed lower edges is chamfered.

In another aspect, there is provided a skate comprising:

a frame;

a plurality of wheels rotatably coupled to the frame;

a foot support coupled to the frame, and configured for supporting a skater's foot;

a foot coupling unit coupled to the frame, and configured for coupling the skater's foot to the foot support; and a carrying tab extending from the frame, and including a hole configured to permit insertion of a human finger to effect support of the skate by a human finger.

In another aspect, there is provided a skate comprising:

a frame including a base and an upwardly extending sidewall extending upwardly from the base;

a plurality of wheels rotatably coupled to the frame and configured to effect rolling motion of the skate across a reaction surface;

a foot support coupled to the frame, and configured for supporting a skater's first foot; and a foot rest, extending from the sidewall, and configured for supporting the skater's second foot when the skater's first foot is supported by the foot support.

In another aspect, there is provided a skate comprising:

a frame;

a plurality of wheels rotatably mounted to the frame and configured to effect rolling motion of the skate across a reaction surface;

a foot support coupled to the frame, and configured for supporting a skater's first foot;

a foot coupling unit coupled to the frame, and configured for coupling a skater's first foot to the foot support; and a foot rest including a footrest member and an operative foot rest support surface, wherein the foot rest member extends from the frame, and the operative foot rest support surface is coupled to the foot rest member and configured for supporting the skater's second foot when the skater's first foot is supported by and coupled to the foot support;

wherein the frame and the foot rest member are integrally formed.

In another aspect, there is provided a skate comprising:

a frame;

a plurality of wheels rotatably coupled to the frame and configured to effect rolling motion of the skate across a reaction surface;

a foot support coupled to the frame, and including an operative foot support surface configured for supporting a skater's first foot;

a foot coupling unit coupled to the frame, and configured for coupling a skater's first foot to the operative foot support surface; and a foot rest, extending from the frame, and including an operative foot rest support surface configured for supporting the skater's second foot when the skater's first foot is supported by and coupled to the operative foot support surface;

wherein the operative foot rest support surface is disposed above the reaction surface by a minimum vertical distance of at least 80 millimeters.

In another aspect, there is provided a skate comprising:

a foot support and coupling structure including:

a frame;

a foot support coupled to the frame, and including an operative foot support surface configured for supporting a skater's first foot, wherein the operative foot support surface includes a longitudinal axis; and a foot rest, extending from the sidewall, and including an operative foot rest support surface configured for supporting the skater's second foot when the skater's first foot is supported by and coupled to the operative foot support surface;

and a plurality of wheels rotatably coupled to the frame;

wherein each of the wheels is disposed substantially beneath the foot support and coupling structure.

In another aspect, there is provided a skate comprising:

a frame including two opposing sides and a guide channel extending between the two opposing sides; and a plurality of wheels rotatably coupled to the frame;

wherein the wheels are spatially configured relative to the guide channel so as not to interfere with guided entry of an object into the guide channel.

BRIEF DESCRIPTION OF DRAWINGS

The preferred embodiments of the invention will now be described with reference to the following accompanying drawings:

FIGS. 5A, 5B, and 5C are top perspective views of suitable foot coupling units for a skate;

FIG. 7 is a top perspective view of the skate of FIG. 2, illustrating the foot rest disposed in operative and inoperative positions;

DETAILED DESCRIPTION OF PREFERRED EMBODIMENTS

Figure 21:
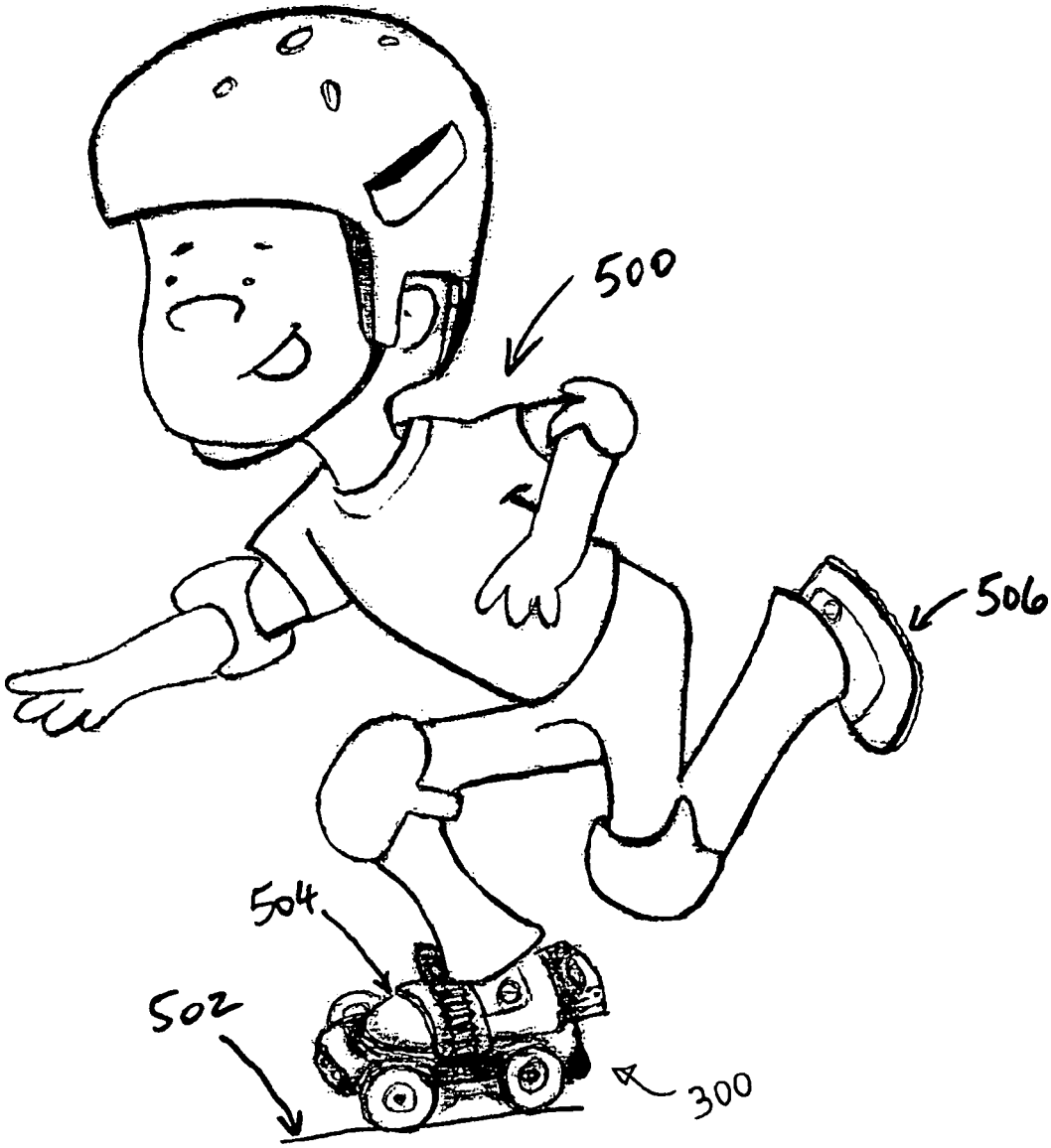
FIG. 21 is a schematic illustration of a skater using the skate of FIG. 12 to effect rolling motion across a reaction surface.

Referring to FIG. 21, a skate 300 is provided for effecting rolling motion of a skater 500 across a reaction surface 502. The skate 300 is configured to be coupled to a skater's single foot 504, and permit the skater 500 to use his or her other foot to propel him or herself across the reaction surface by pushing off the reaction surface 502.

Referring to the embodiment illustrated in FIGS. 1 to 7 and 10 and 11, there is provided a skate 100 including a frame 4, a plurality of wheels 7*a*, 7*b*, 7*c* and 7*d*, a foot support 9, a foot coupling unit 14, and a foot rest 27.

For example, the frame 4 is handmade from wood. Alternatively, the frame 4 can be formed from a plastic such as, for example, polyurethane. As well, the frame 4 can be formed from aluminium.

Figure 4A:
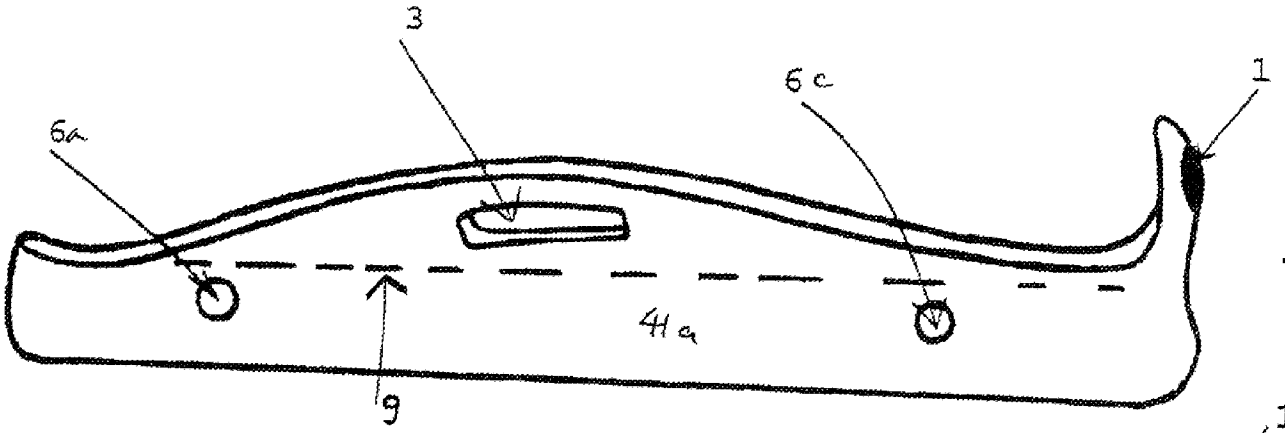
FIG. 4A is a side elevation view of a frame of the skate illustrated in FIG. 2.
Figure 4B:
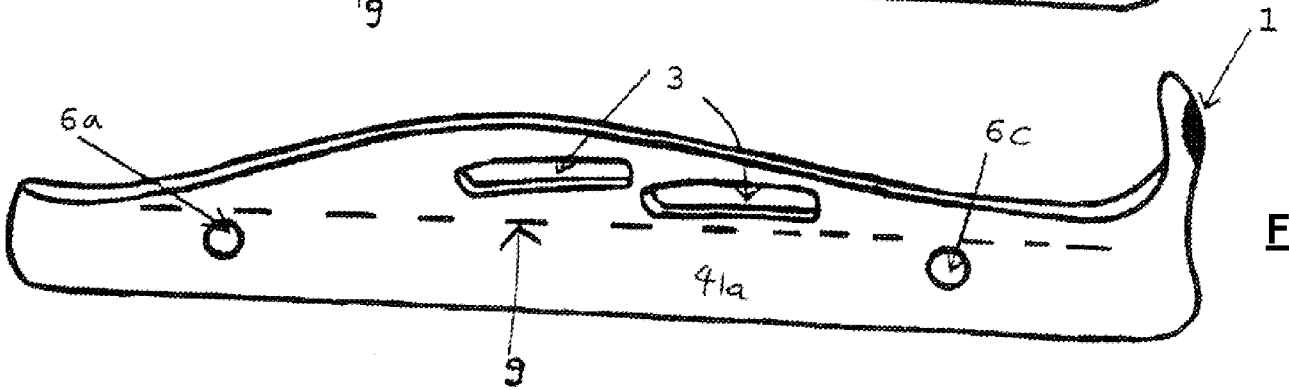
FIG. 4B is a side elevation view of another example of a frame of a skate.
Figure 6:
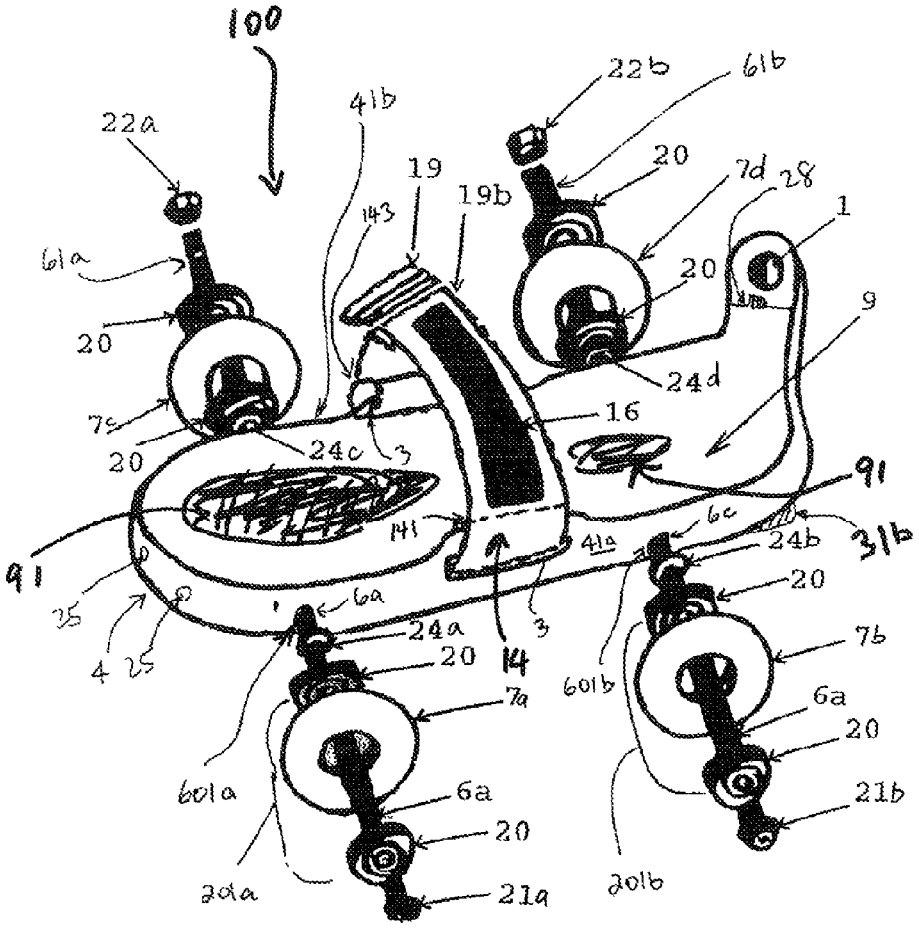
FIG. 6 is an exploded view, in top perspective, illustrating the skate of FIG. 2.

Referring specifically to FIGS. 4A, 4B and 6, the frame 4 includes a first pair of aligned apertures 6*a*, 6*c* joined by a bore 601*a*, and second pair of aligned apertures 6*b*, 6*d* joined by a bore 601*b*. The apertures 6*a*, 6*c* are provided on side 41*a* of the frame 4. The apertures 6*b*, 6*d* (not shown) are provided on side 41*b* of the frame 4. The longitudinal axes of the bores 601*a*, 601*b* are substantially parallel. Each of the bores 601*a*, 601*b* receives a respective axle 61*a*, 61*b* in the form of a hexagonal axle bolt 21*a*, 21*b*. Each of the axle bolts 21*a*, 21*b* extends through a respective one of the bores 601*a*, 601*b*, and laterally and outwardly relative to each side 41*a*, 41*b* of the frame 4. Each of the axle bolts 21*a*, 21*b* is provided to effect rotatable coupling of a respective one of the two pairs of wheels 7*a*, 7*b* and 7*c*, 7*d* to the frame 4. The wheels 7*a*, 7*b*, 7*c*, and 7*d* facilitate rolling travel of the skate 100 across a reaction surface. Axle bolt 21*a* effects coupling of the wheel 7*a* laterally adjacent to side 41*a*, and also effects coupling of wheel 7*b* laterally adjacent to side 41*b*. Axle bolt 21*b* effects coupling of the wheel 7*c* laterally adjacent to side 41*a*, and also effects coupling of wheel 7*d* laterally adjacent to side 41*b*. Each of the wheels 7*a*, 7*b*, 7*c*, and 7*d* is rotatably coupled to a respective one of the axle bolts 21*a*, 21*b* with a respective one of the bearing assemblies 201*a*, 201*b*, 201*c*, and 201*d*. Each of the bearing assemblies 201*a*, 201*b*, 201*c*, and 201*d* including two bearings 20. For each of the wheels 7*a*, 7*b*, 7*c*, and 7*d*, the two bearings 20 are inserted and press-fitted within the hub of the wheel to thereby hold them in place and connect the bearings 20 to the wheel. For example, a suitable bearing 20 is a Bones Swiss™ standard "608" bearing. A respective washer 24*a*, 24*b*, 24*c*, and 24*d*, is disposed between a respective one of the bearing assemblies 201*a*, 201*b*, 201*c*, and 201*d* and the frame 4, so as to effect spacing of each of the wheels 7*a*, 7*b*, 7*c*, and 7*d* from the frame 4. Because each of the axles is in the form of a respective one of the axle bolts 21*a*, 21*b*, a respective one of the nut 22*a*, 22*b* is screwed to the end of a respective one of the axle bolts 21*a*, 21*b*, so that the wheels 7*a*, 7*b*, 7*c*, and 7*d* are coupled to the frame 4.

Each of the wheels 7*a*, 7*b*, 7*c*, and 7*d* may be the same as those used in in-line skates. For example, each of the wheels 7*a*, 7*b*, 7*c*, and 7*d* is a polyurethane roller wheel. For example, each of the wheels 7*a*, 7*b*, 7*c*, and 7*d* has a diameter of 72 millimeters. For example, each of the wheels is Oxygen™ brand, 72 millimeters in diameter, having 76 durometer (hardness), with ABEC 3 Bearings, 60822, Twincam.

Figure 1:
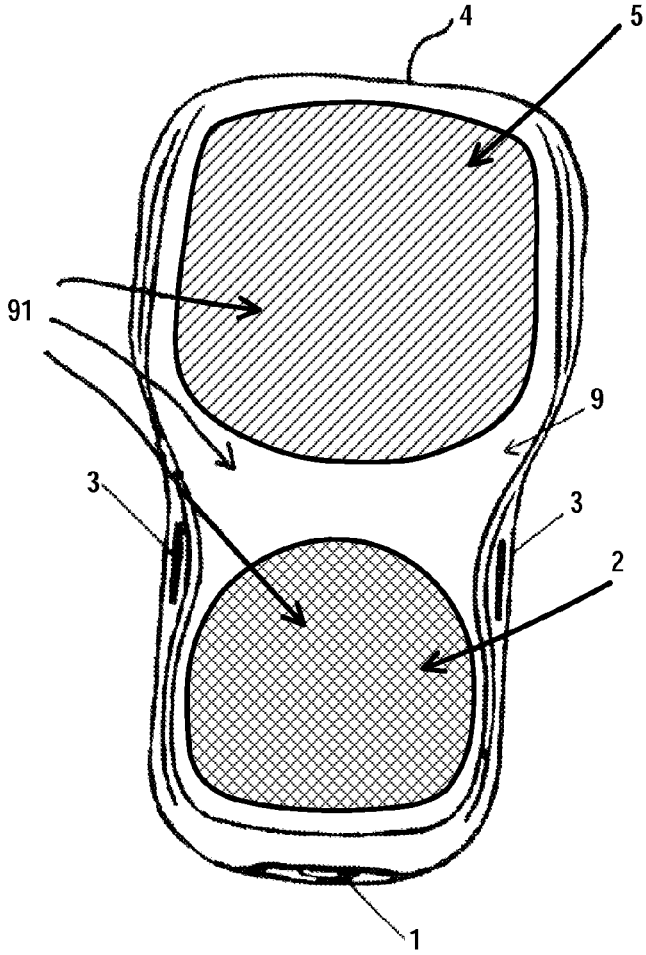
FIG. 1 is a top plan view of a foot support surface of a skate.
Figure 2:
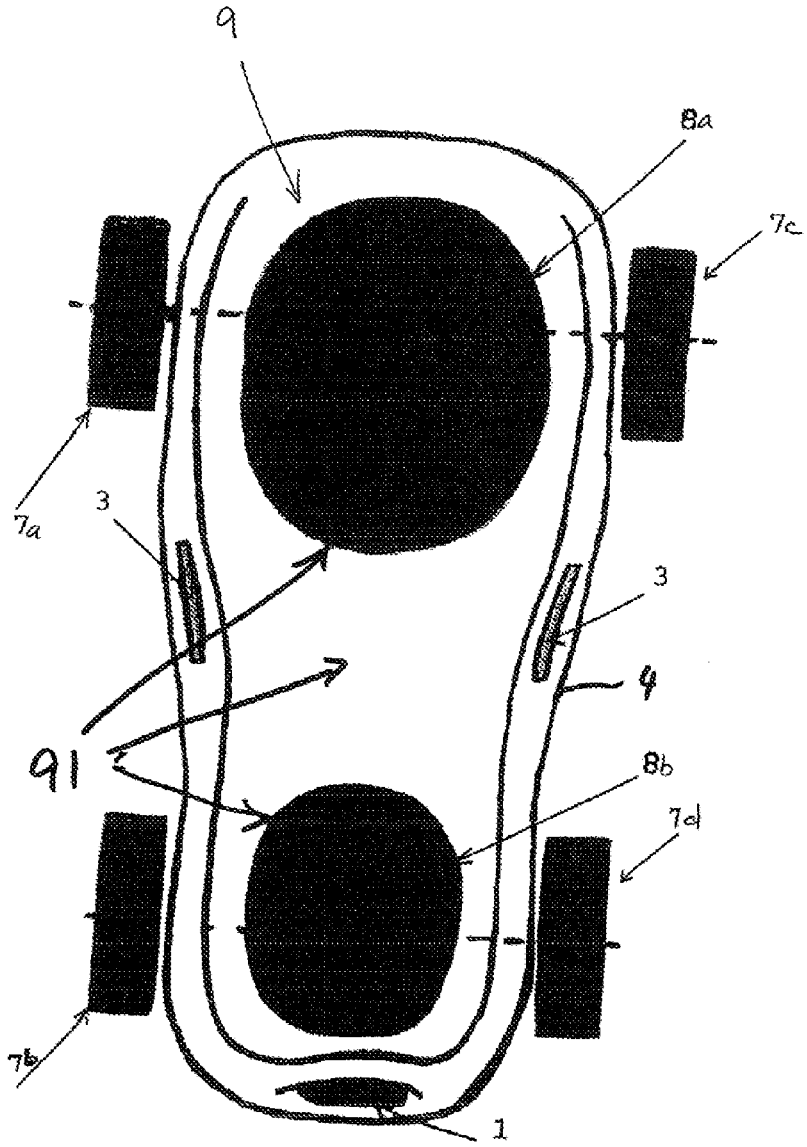
FIG. 2 is a top plan view of a skate, where the foot coupling unit has been removed for clarity.
Figure 3:
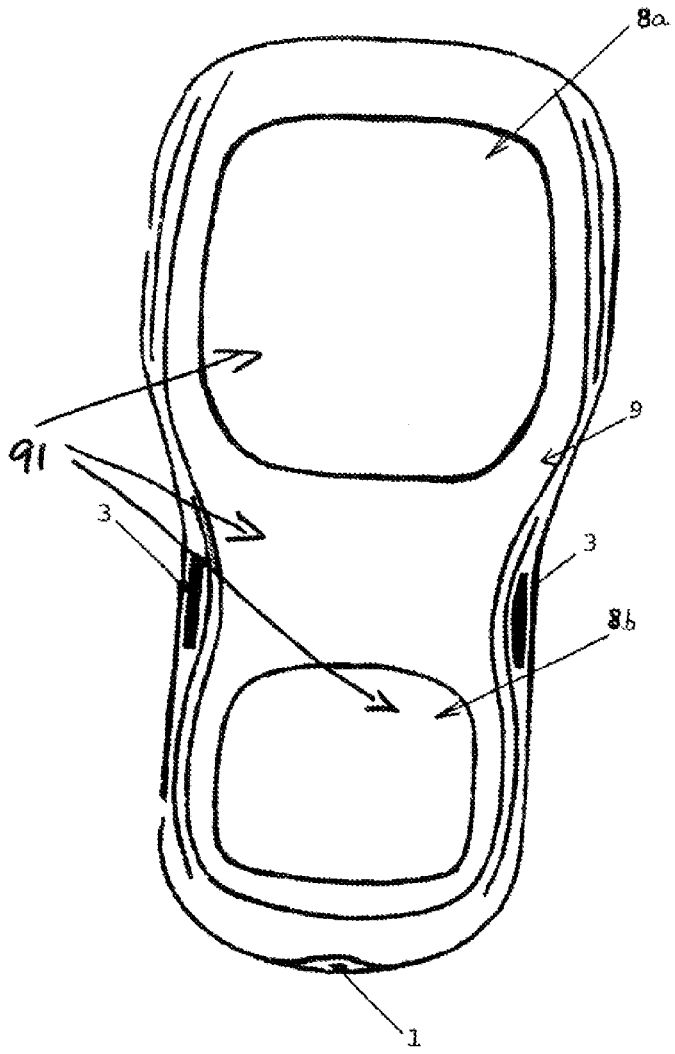
FIG. 3 is a top plan view of another example of a foot support surface of a skate.
Figure 10:
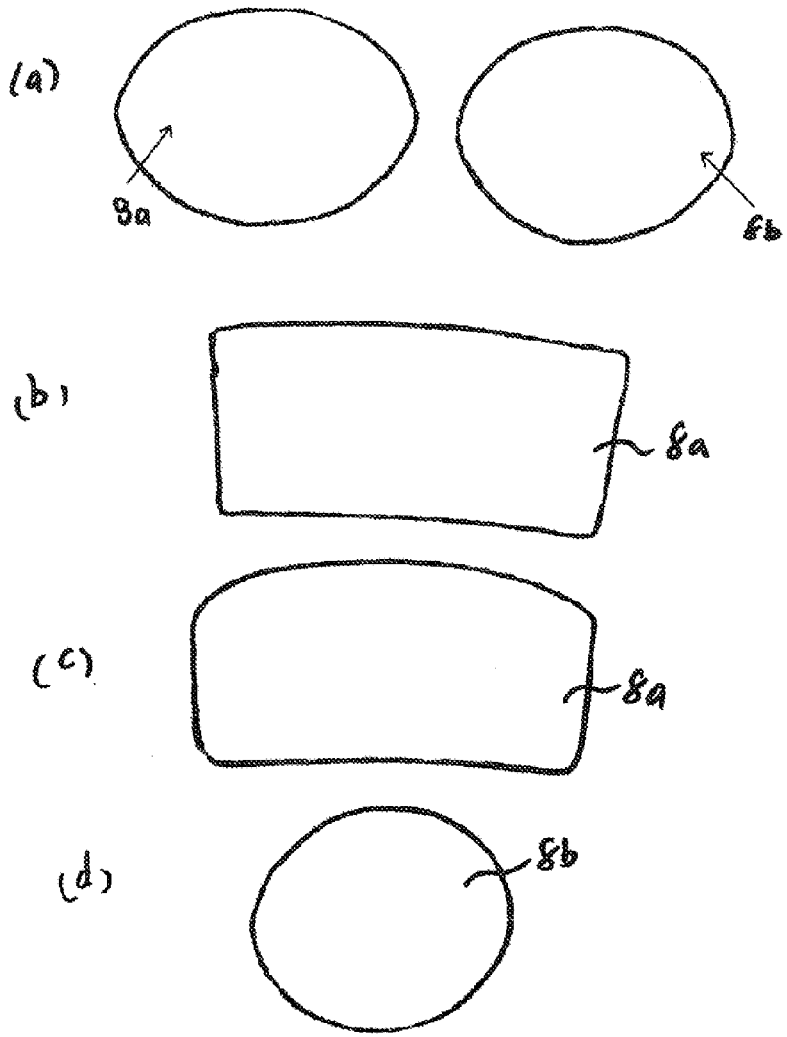
FIGS. 10A, 10B, 10C, 10D are schematic illustrations of examples of suitable gripping surfaces of the foot support surface of a skate.

The foot support 9 is coupled to the frame 4. Referring to FIGS. 1, 2, 3, 6 and 7, the foot support 9 includes an operative foot support surface 91 for supporting a skater's first foot. For example, and referring to FIG. 2, the operative foot support surface 91 is defined, at least in part, by two regions 8*a*, 8*b* of sandpaper grip tape which is adhered to the upper surface of the frame 4. Other suitable shapes for the gripping surfaces of the regions 8*a*, 8*b* are illustrated in FIGS. 3 and 10. Alternatively, referring to FIG. 1, the top surface of the frame can be scraped with a blade at regions 2 and 5 to form a cross-grilled pattern at region 5 and a grooved line grip at region 2 to provide better traction for the skater's first foot. Various shape configurations for gripping surfaces for the regions 8*a*, 8*b* are illustrated in FIGS. 10A, 10B, 10C, and 10D.

Referring to FIGS. 6 and 7, the foot coupling unit 14 is configured for coupling the skater's first foot to the operative foot support surface 91 of the foot support 9. Examples of a suitable foot coupling unit 14 is illustrated in FIGS. 5A, 5B, and 5C.

FIG. 5A illustrates a strap including four elastic fabric band portions 10, a relatively inelastic fabric portion 11, and a pull cord 12. The FIG. 5A strap is intended to be used with the frame 4 illustrated in FIG. 4B. The embodiment of the frame 4 in FIG. 4B includes two strap insert apertures 3 on each side of the frame (only one side of the frame 4 is illustrated in FIG. 4B), for a total of four strap insert apertures. Each of the four elastic fabric band portions 10 are stitched to the fabric portion 11. As well, the pull cord 12 is stitched to the fabric portion 12. Each of the four elastic band portions is inserted into a respective one of the four strap insert apertures and is then stitched in place onto itself at seam lines 10*a* to effect coupling of the foot coupling unit 14 to the frame 4.

FIG. 5B illustrates another strap including an elastic fabric band portion 13, a relatively inelastic fabric band portion 14, a fabric coupling portion 19*b*, a plastic "B" ring 17, and a neoprene grip 19. The FIG. 5A strap is intended to be used with the frame 4 illustrated in FIG. 4A. The embodiment of the frame 4 in FIG. 4A includes a single strap insert aperture 3 on each side of the frame (only one side of the frame 4 is illustrated in FIG. 4A). One end of the portion 13 is inserted through an aperture 3 on one side of the frame 4 and is stitched in place onto itself at seam line 141*a*, and the other end of the first portion 13 is inserted through the ring 17 and then stitched in place onto itself at seam line 141*b*. One end of the portion 14 is inserted through the aperture 3 on the other side of the frame 4 and is stitched in place onto itself at seam line 143*a*, and the other end of the second portion 13 is stitched onto one end of the portion 19*b* at seam line 143*b*. The other end of portion 19*b* is stitched to the grip 19. One side of portion 19*b* includes a Velcro™ hook region 15 and a Velcro™ loop region 18. The other side of portion 19*b* includes reflector tape 16. Portion 19*b* is inserted through ring 17 such that the Velcro™ hook region and the Velcro™ loop region are overlaying each other.

FIG. 5C illustrates another strap including first and second fabric band portions 14*a*, 14*b*, first and second fabric coupling portions 1911*b*, 1913*b*, and a neoprene grip 19. One side of the first portion 1911*b* includes a Velcro™ loop region 18 and the other side includes reflector fabric 16. One side of the second portion 1913*b* includes a Velcro™ hook region 15, and the other side is fabric. The FIG. 5C strap is intended to be used with the frame 4 illustrated in FIG. 4A. The embodiment of the frame 4 in FIG. 4A includes a single strap insert aperture 3 on each side of the frame (only one side of the frame 4 is illustrated in FIG. 4A). One end of the first portion 14 is stitched to the first portion 1911*b* such that the Velcro™ loop region 18 is directed downwardly, and the second end of the first portion 14 is inserted through an aperture 3 on one side of the frame 4 and is stitched in place onto itself at seam line 141. One end of the second portion 13 is stitched to the second portion 1913*b* such that the Velcro™ hook region is directed upwardly, and the second end of the second portion 13 is inserted through an aperture 3 on the other side of the frame 4 and is stitched in place onto itself at seam line 143.

Referring to FIGS. 6 and 7, the foot rest 27 extends upwardly from the frame 4. In the embodiment illustrated, the footrest 27 is formed integrally with the frame 4, and is formed from the same material as the frame 4. The footrest 27 includes an operative foot rest support surface 271 configured for supporting the skater's second foot when the skater's first foot is supported by and coupled to the foot support 9. In the embodiment illustrated in FIGS. 6 and 7, the footrest 27 also functions as a rear sidewall for limiting movement of the heel of a skater's first foot when the skater's first foot is supported by and coupled to the foot support 9.

Figure 7A:
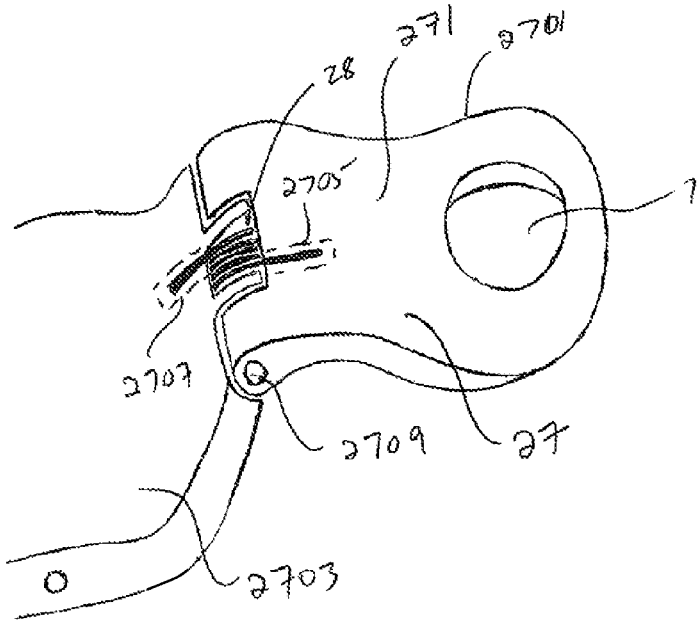
FIG. 7A is a top perspective view of a fragment of the foot rest of the skate of FIG. 2, partly in section.
Figure 7B:
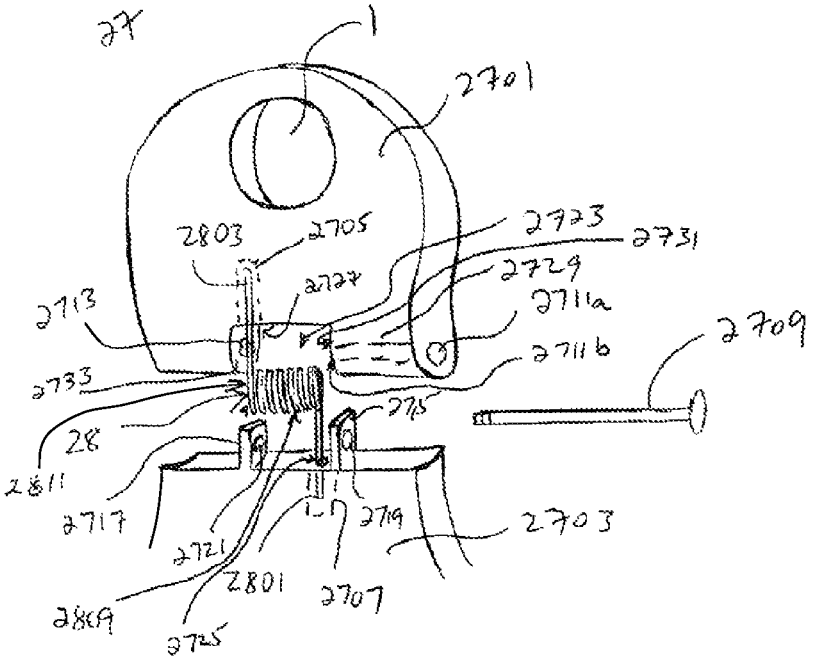
FIG. 7B is an exploded view, in top perspective, of the foot rest fragment illustrated in FIG. 7A.

Referring to FIGS. 6, 7, 7*a*, 7*b*, the operative foot rest support surface 271 is disposed on an upper region 2701 of the footrest 27. This upper region 2701 is hingedly coupled to a lower region 2703 by a spring clip 28. The spring clip 28 biases the upper region 2701 to an inoperative position 27*a*. Referring to FIG. 7, in the inoperative position 927*a*, the upper region 2701 is substantially upright and the operative foot rest surface 271 is not disposed in a position favourable to supporting the skater's second foot. Upon application of a force in the rearward direction to the upper region 2701, such as by the heel of the skater's second foot, the upper region 2701 is forced to bend back on the spring clip 28, and thereby move downwardly, until stopped by the spring clip 28 at the operative position 927*b*. When the upper region 2701 is in the operative position 27*b*, the operative foot rest surface 271 is disposed in a position favourable for supporting the skater's second foot, and is also disposed above the reaction surface (across which the skate is configured to facilitate rolling motion) by a minimum vertical distance of at least 7 centimeters and a maximum vertical distance of less than 14 centimeters. For example, each of the maximum vertical distance and the minimum vertical distance is about the same. For example, the maximum vertical distance and the minimum vertical distance is the same, and is 8 centimeters.

Referring to FIGS. 7A and 7B, the spring clip 28 is coupled to each of the upper and lower regions 2701, 2703. A recess 2723 is provided in the upper region 2701 in order to receive the spring clip 28, and the spring clip 28 is supported upon an upper surface 2729 of the lower region 2703 between spaced apart tabs 2715, 2717 extending upwardly from the upper surface 2729. The tabs 2715, 2717 are configured for fitting within the recess 2723, for reason which will become apparent below. The spring clip 28 includes free ends 2801 and 2803 and a spiral wound portion 2809 disposed between the free ends 2801, 2803. The spiral wound portion 2809 defines a passage 2811. The free end 2801 is received within a bore 2707 extending from an aperture 2725 provided in the upper surface 2729 of the lower region 2703. The free end 2803 is received within a bore 2705 extending from an aperture 2727 which opens into the recess 2723. The spring clip 28 is coupled to the upper and lower regions 2701, 2703 by a pin 2709. The upper region 2701 includes an aperture 2711*a* and a bore 2729 extending through the upper region and opening through a wall portion 2731 and into the recess 2723 through an aperture 2711*b* which is aligned with the aperture 2711*a*. A wall portion 2733 opposite to the wall portion 2731 includes an aperture 2713 which is aligned with the apertures 2711*a*, 2711*b*. Each of the tabs 2715, 2717 includes a respective one of apertures 2719, 2721. The apertures 2719, 2721 are aligned with each other. When the spring clip 28 is positioned between the tabs 2715, 2717, and each of the free ends 2801, 2803 is inserted in a respective one of the bores 2707, 2705, when the tabs 2715, 2717 become fitted within the recess 2723, the apertures 2719, 2721 of the tabs 2715, 2717 and the passage 2811 of the spiral wound portion 2809 of the spring clip 28 become aligned with the apertures 2711*b*, 2713 of the upper region (and, therefore, the bore 2729 and the aperture 2711*a*). Thus, the pin 2709 can be inserted through the aperture 2711*a*, the bore 2729, the apertures 2711*b*, 2719, and through the passage 2811, and through the aperture 2717, and into the aperture 2713, to effect coupling of the upper region 2701 to the lower region, and to facilitate the positioning of the upper region 2701 relative to the lower region 2703, as described above.

The upper region 2711 also includes a hole 1 configured to permit insertion of a human finger to effect support of the skate by a human finger. The hole 1 has a substantially horizontal axis. The skate 100 can be carried by a human finger when the skate 100 is not in use. In this respect, the footrest 27 also functions as a carrying tab.

Referring to FIG. 7, the skate 100 includes light diodes 25 coupled to a front end 411*b* of the frame 4. The diodes function as lights for improving visibility in circumstances where visibility is not optimal. It is envisioned to supply power is supplied to each of the diodes with a respective battery. It is contemplated that each of the diode and battery combinations could be inserted within a slot formed within the front end 411*b* of the frame 4, and could be mounted within the slot by press fitting the combination within the slot or mounting a transparent or translucent plate to the front end 411*b* of the frame 4 while covering the slot.

Figure 8A:
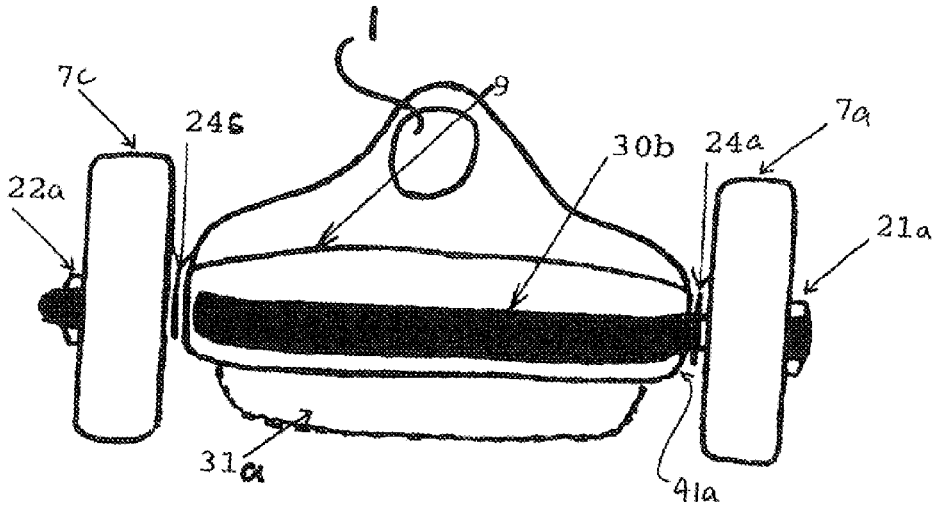
FIG. 8A is a front elevation view of the skate of FIG. 2.
Figure 8B:
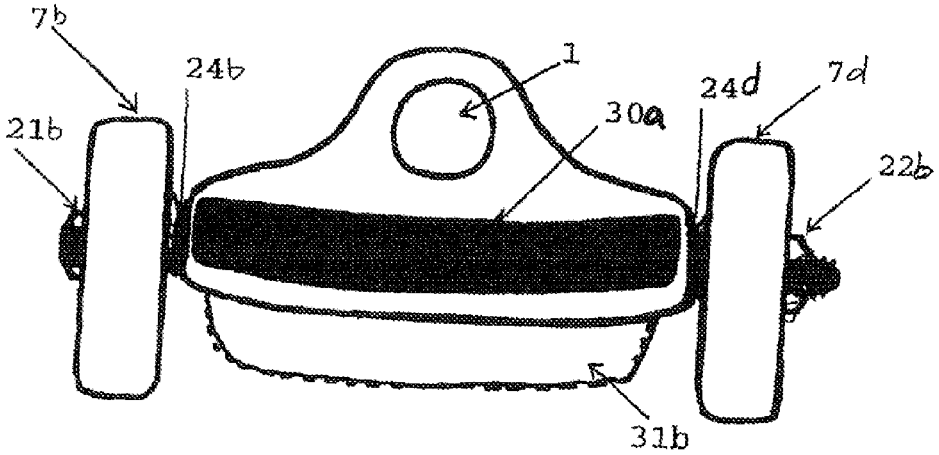
FIG. 8B is a rear elevation view of the skate of FIG. 2.
Figure 9:
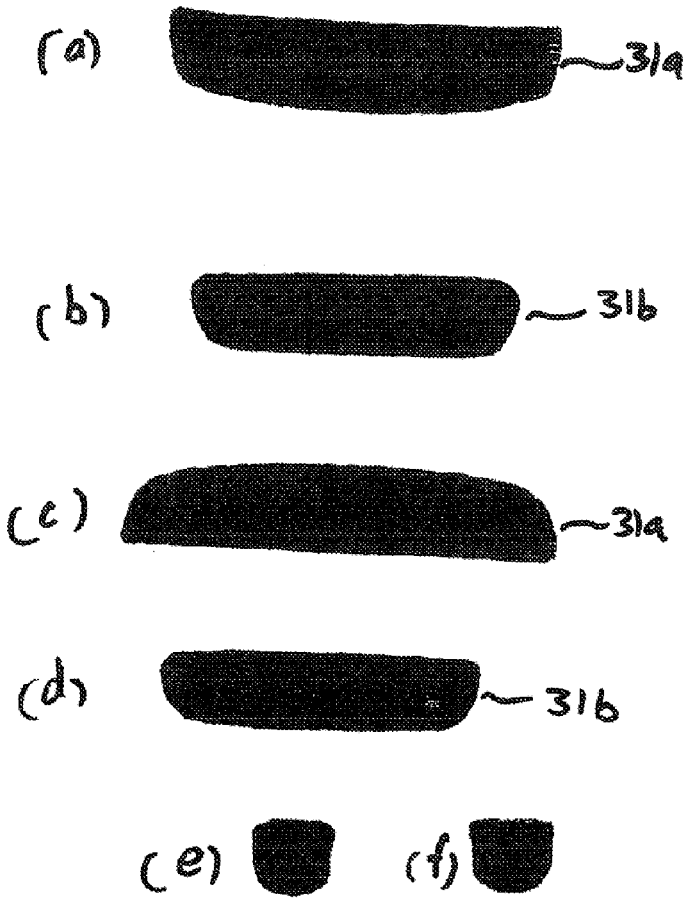
FIG. 9A is a front elevation view of the front brake of the skate of FIG. 2.
FIG. 9B is a rear elevation view of the rear brake of the skate of FIG. 2.
FIG. 9C is a bottom plan view of the front brake of the skate of FIG. 2.
FIG. 9D is a bottom plan view of the rear brake of the skate of FIG. 2.
FIG. 9E is a side elevation view of one side of either the front or rear brake of the skate in FIG. 2.
FIG. 9F is a side elevation view of the other side of either of the front or rear brake of the skate in FIG. 2.
Figure 11:
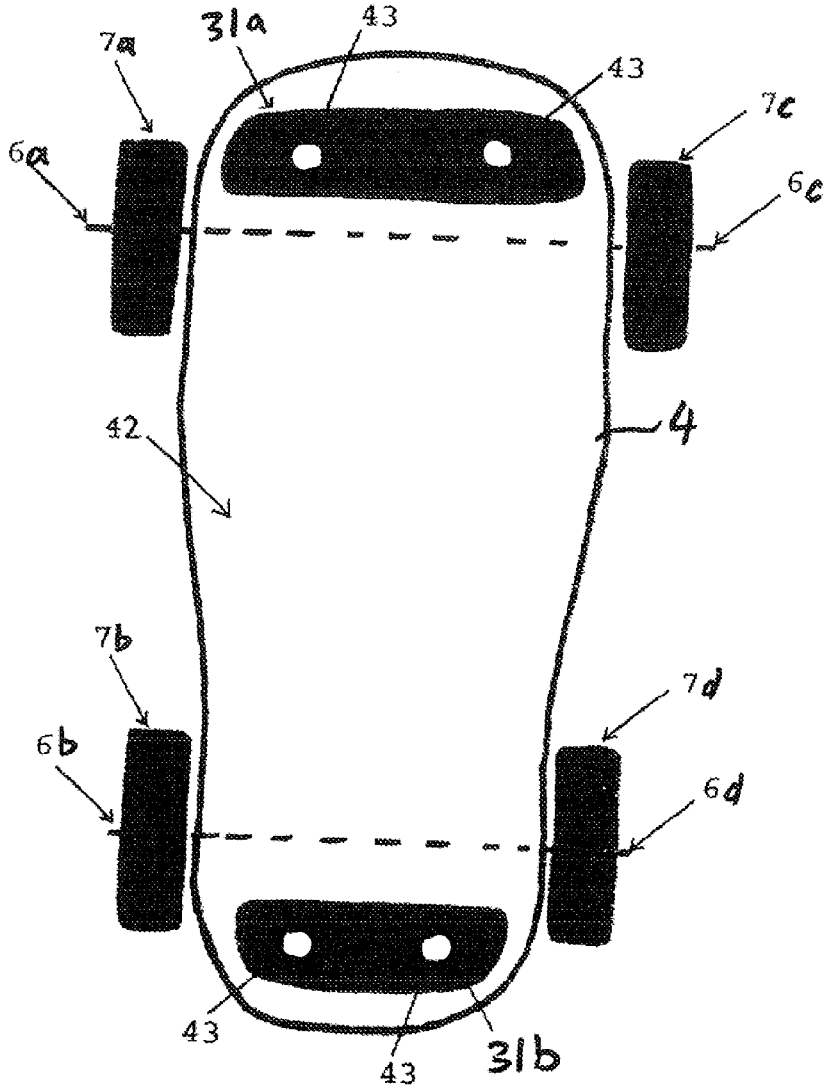
FIG. 11 is a bottom plan view of the skate of FIG. 2.
Figure 12:
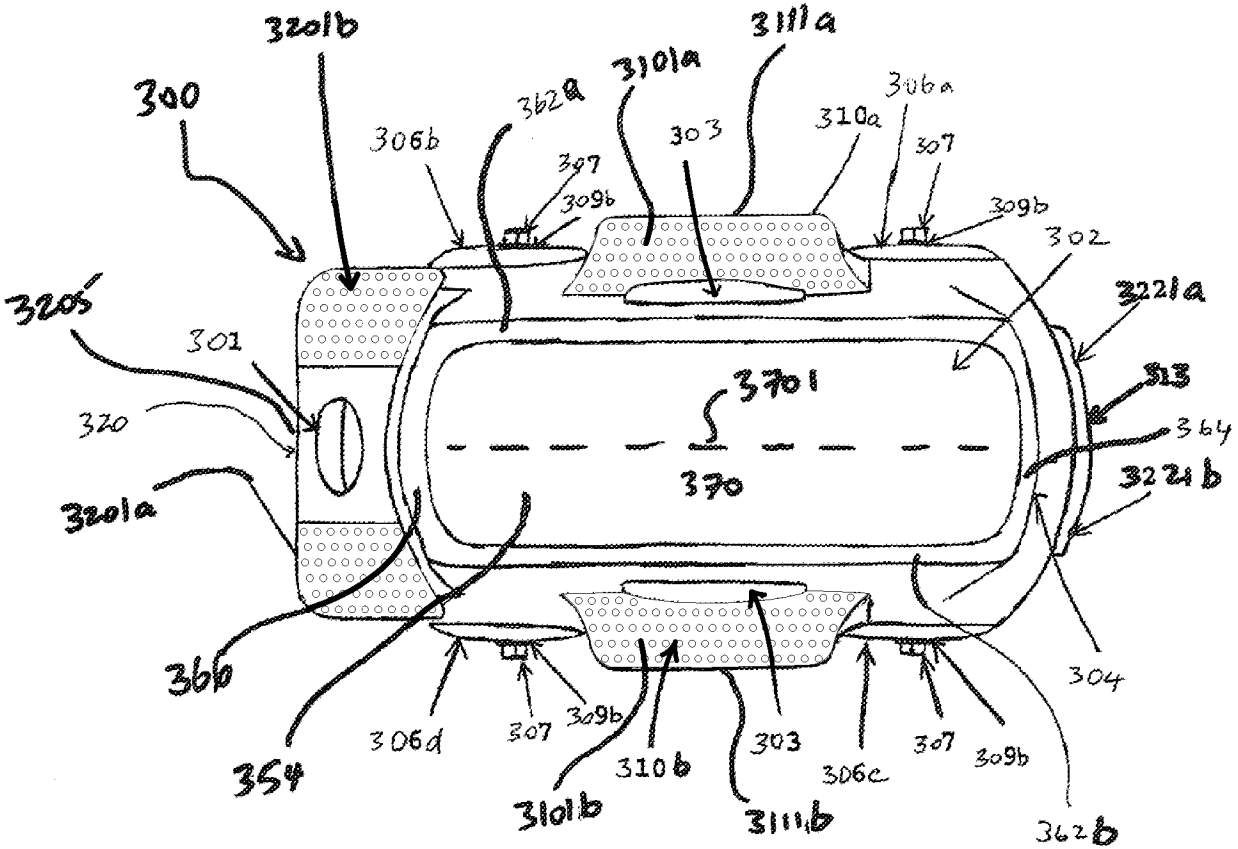
FIG. 12 is a top plan view of a second embodiment of a skate, with the foot coupling unit removed for clarity.

Referring to FIGS. 8A, 8B, and 11, brakes 31*a*, 31*b* are coupled to the bottom surface of the frame 4 by screws 43 which are threaded through aligned, threaded apertures in the brakes 30*a*, 30*b* and the frame 4. Various views of the brakes 31*a*, 31*b* are illustrated in FIGS. 9A, 9B, 9C, 9D, 9E, and 9F.

Each of the brakes 31*a*, 31*b* includes a respective braking surface which is configured to effect frictional resistance to movement of the skate 200 when the skater shifts his or her body weight so as to cause the respective braking surface to come into frictional engagement with the reaction surface upon which the skate 200 is travelling. For example, the braking surface is vulcanized rubber.

In an embodiment illustrated in FIGS. 8A, 8B, and 11, there is provided a skate 200, which is similar to the embodiment of skate 100, with the exception that skate 200 includes reflector tape 30*a*, 30*b*. Reflector tape 30*a* is coupled to a rear end 411*a* of the frame 4. Reflector tape 30*b* is coupled to the front end 411*b* of the frame 4. Each of reflector tape 30*a*, 30*b* is provided to effect illumination of the skate 200 by reflecting light.

A further embodiment of a skate 300 is illustrated in FIGS. 12 to 27. The skate 300 includes a frame 354, a plurality of wheels 306*a*, 306*b*, 306*c* and 306*d*, a foot support 302, a foot coupling unit 329, a pair of lateral foot rests 310*a*, 310*b*, and a rear footrest 320.

For example, the frame 354 is formed from an acrylonitrile butadiene styrene material, such as fibre-reinforced acrylonitrile butadiene styrene. The frame can be manufactured by injection molding.

Referring to FIGS. 12, 13, 15, 16, 17, 18, and 19, the frame 354 includes a base 358 and a continuous wall 360. The wall 360 extends upwardly from the base 358. The wall 360 defines a pair of opposing sidewalls 362*a*, 362*b*, and opposing front and rear walls 364, 366. At least a portion of the space between the sidewalls 362*a*, 362*b* and front and rear walls 364, 366 is configured to accommodate a skater's first foot.

Figure 13:
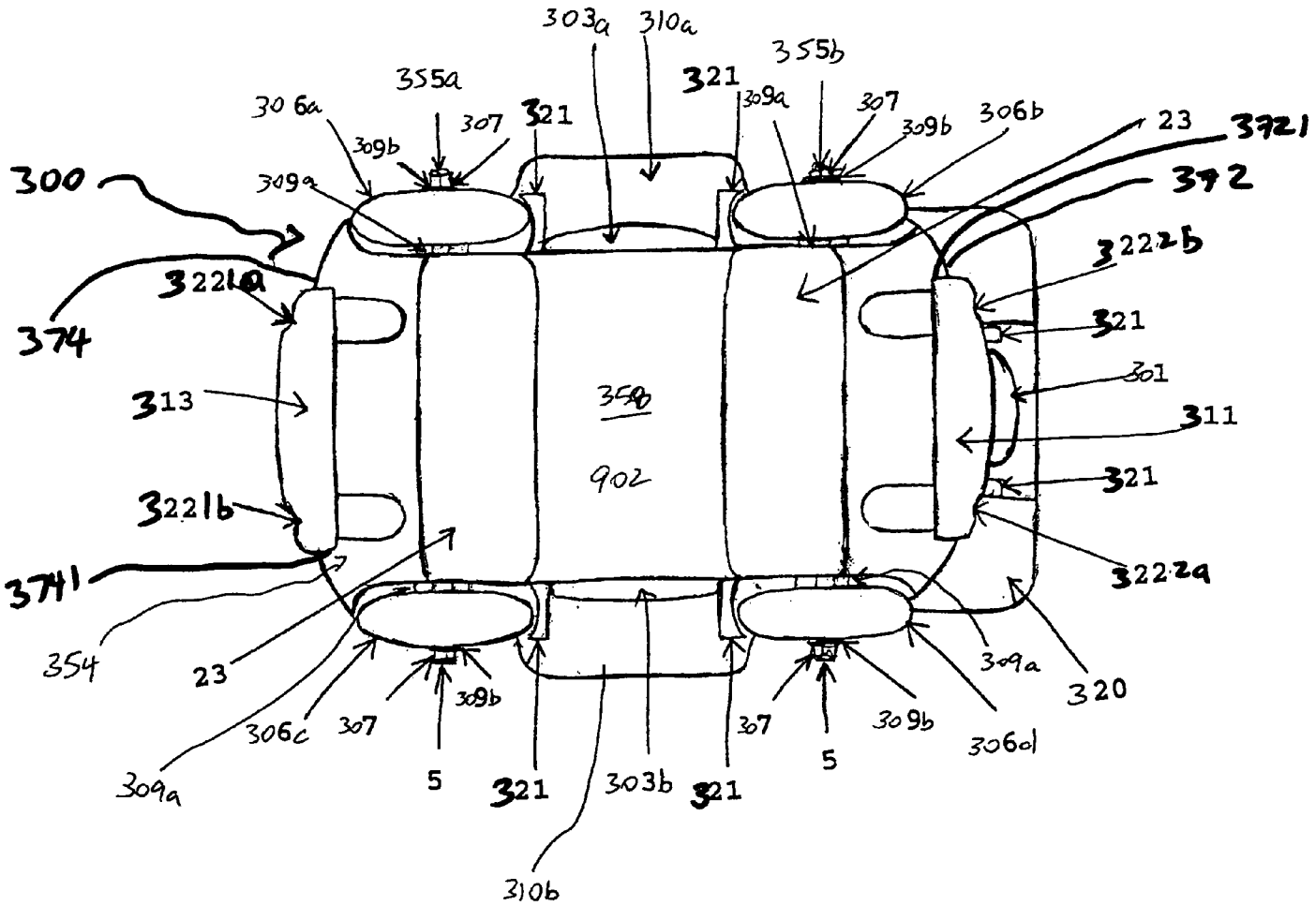
FIG. 13 is a bottom plan view of the skate of FIG. 12, with the foot coupling unit removed for clarity.
Figure 15:
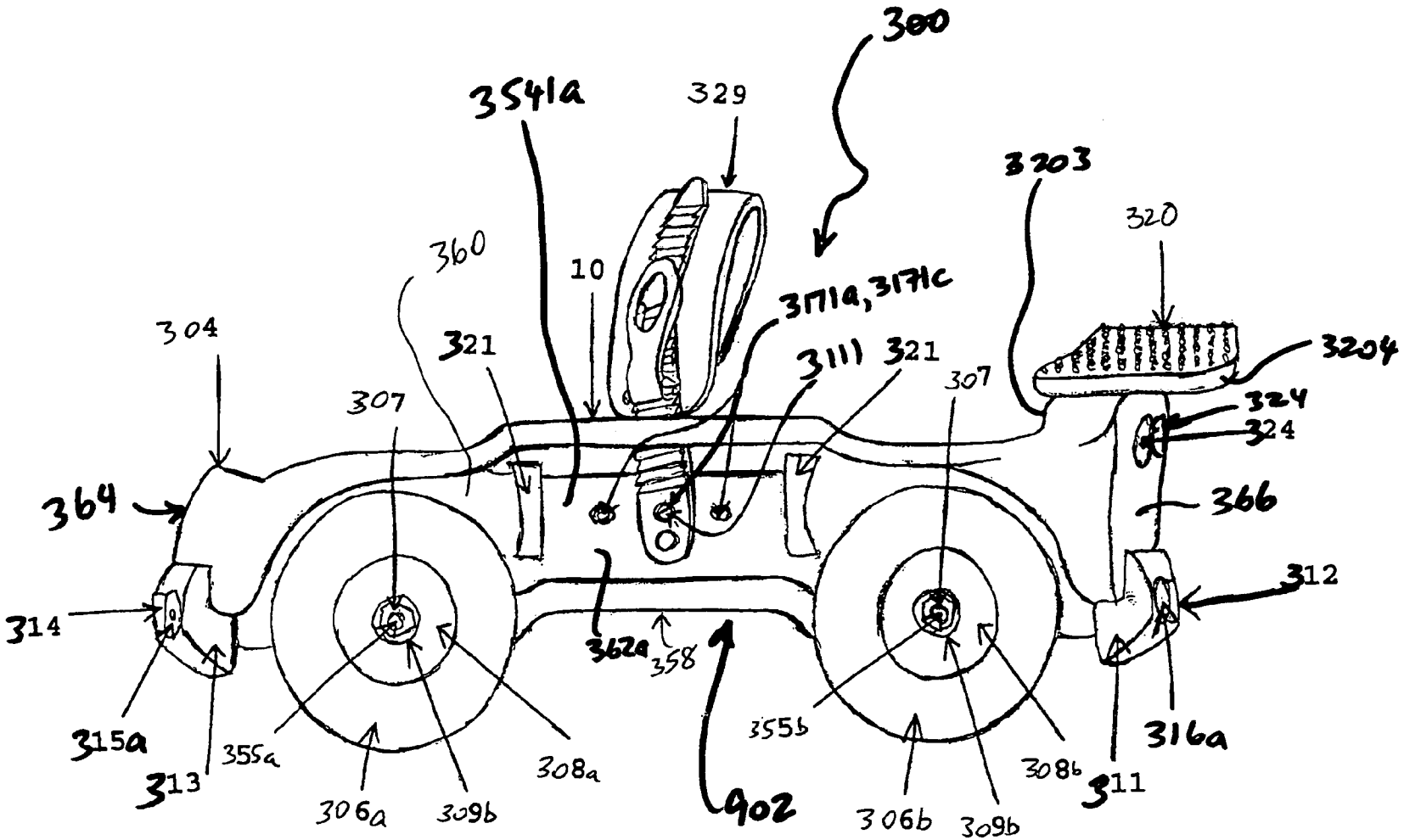
FIG. 15 is a side elevation view of one side of the skate of FIG. 12.
Figure 28:
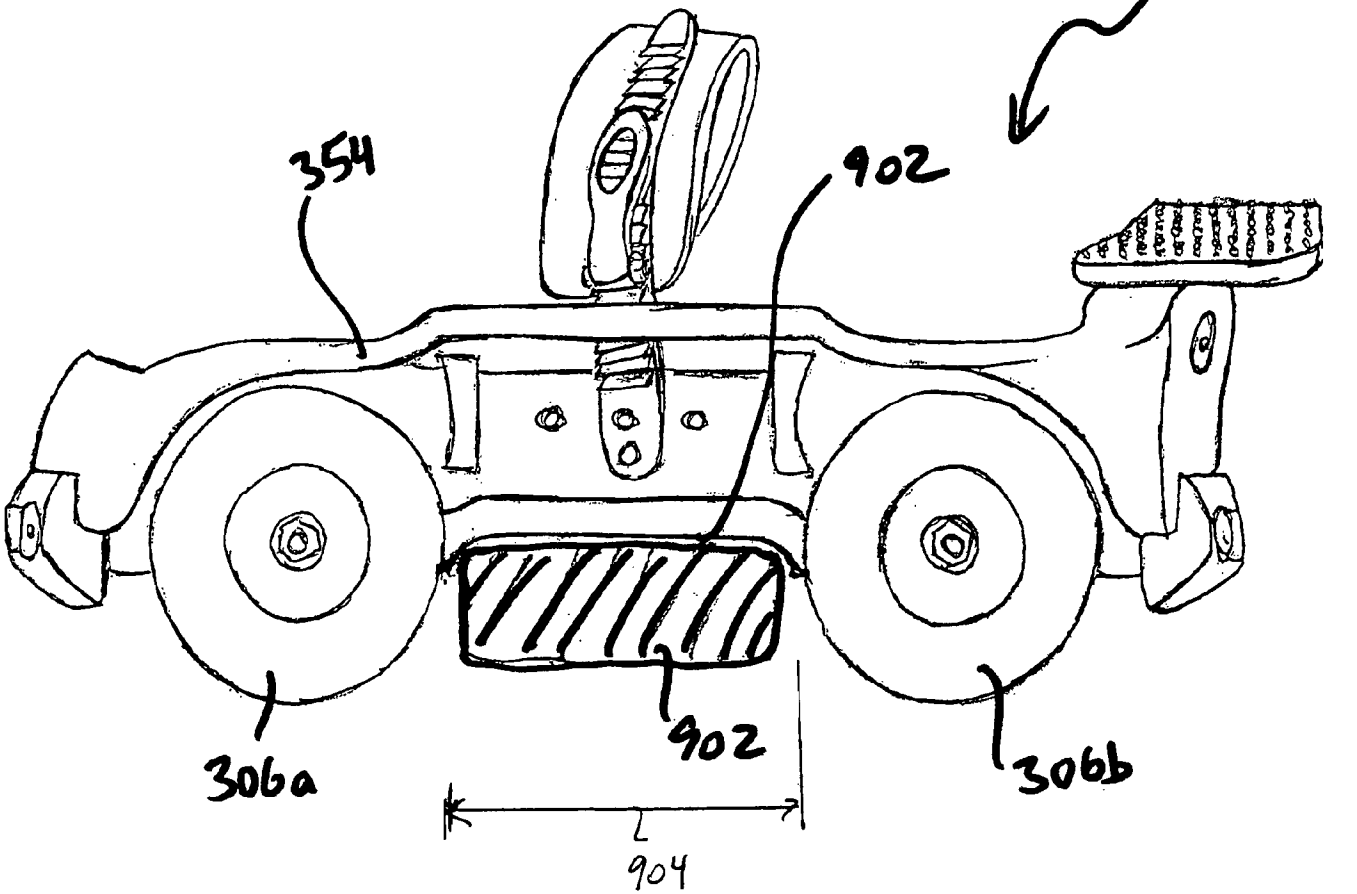
FIG. 28 is a side elevation view of one side of the skate of FIG. 12, illustrating the channel provided in the frame of the skate receiving entry of an object without interference from the surrounding wheels.

Referring to FIGS. 13, 15, and 28, the frame 354 also defines a channel 900 extending between the sides 362*a*, 362*b* of the frame 354. The front wheels 306*a*, 306*c* and the rear wheels 306*b*, 306*d* are spatially configured relative to the guide channel 900 so as not to interfere with the guided entry of an object 902 (such as a rail) into the channel 900, wherein the channel facilitates the guiding of the entry of the object. In this respect, for example, the outer extent or periphery of each of the wheels 306*a*, 306*b* 306*c*, 306*d* is spaced apart from the neighbouring edge of the channel by about 10 millimeters. The channel is disposed between the front and rear wheels. For example, the length 904 of the channel 900 is 91 millimeters.

Figure 14:
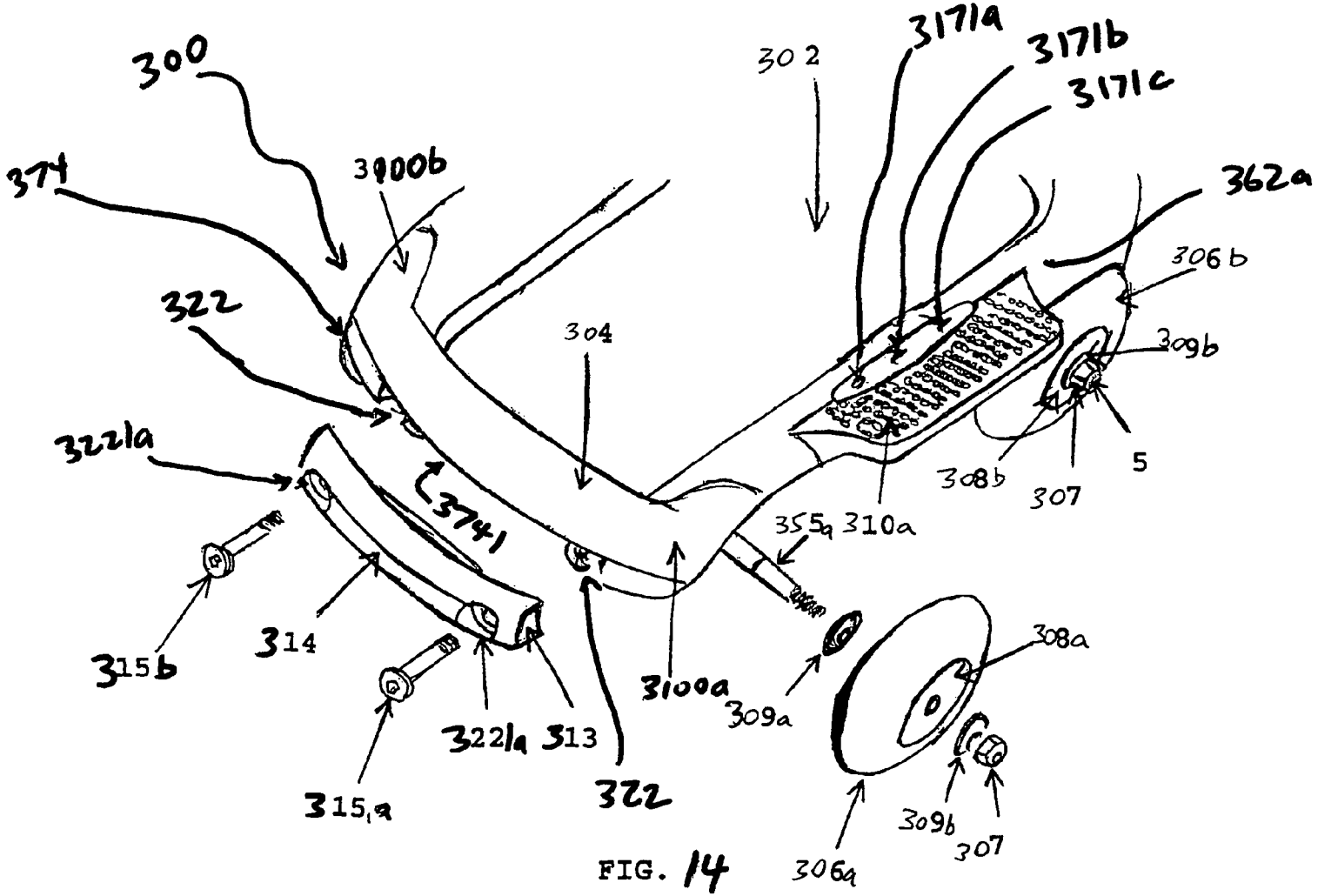
FIG. 14 is an exploded view, in top perspective, of a front segment of the skate of FIG. 12, with the foot coupling unit removed for clarity.
Figure 17:
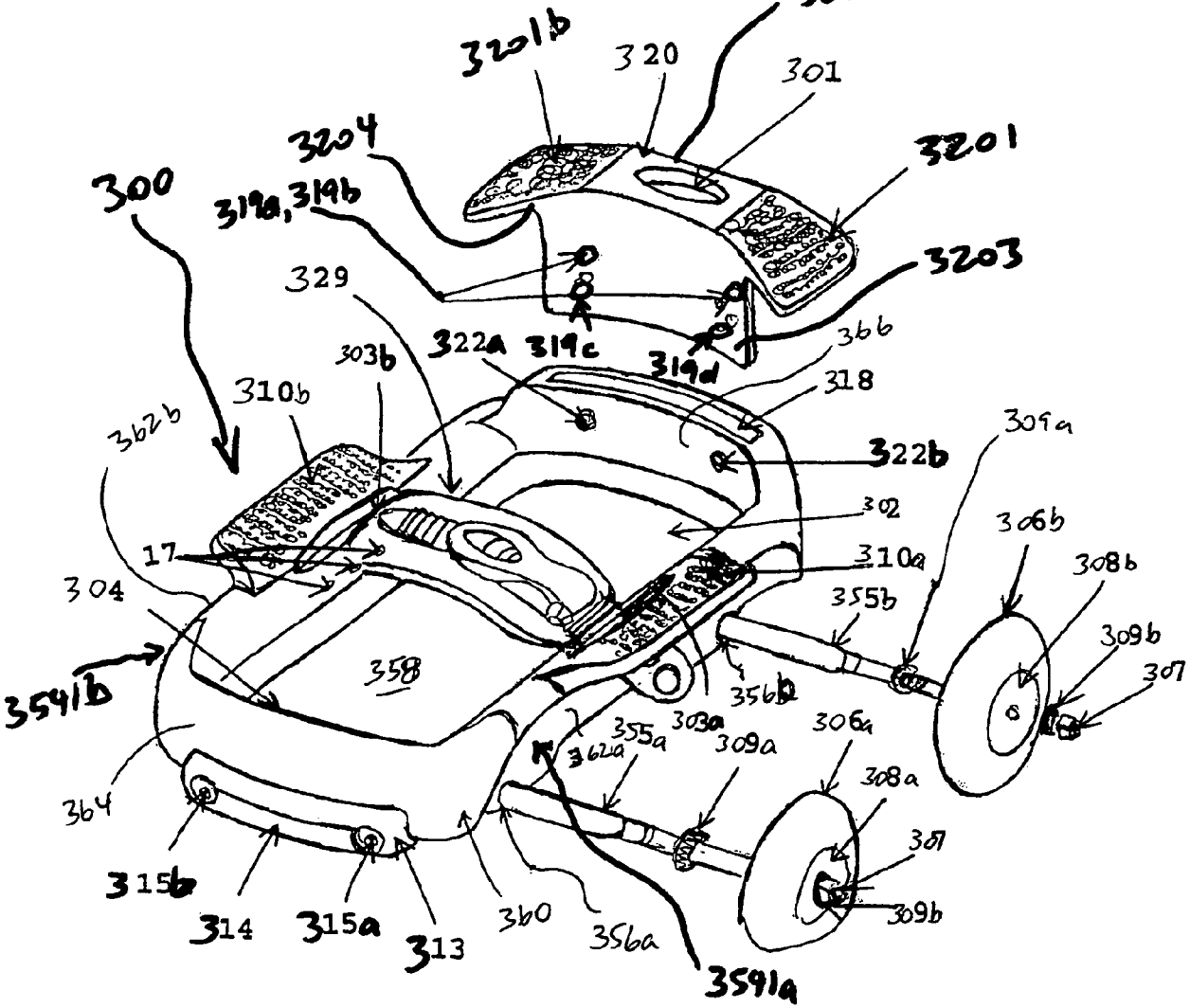
FIG. 17 is an exploded view, in top perspective, of the skate of FIG. 12.

Referring to FIGS. 14 and 17, the frame 354 includes a first pair of aligned apertures 356*a*, 356*c* (aperture 356*c* is not shown) joined by a bore (not shown), and a second pair of aligned apertures 356*b*, 356*d* (aperture 356*d* is not shown) joined by a bore (not shown). The apertures 356*a*, 356*b* are provided on one side 3541*a* of the frame, and the apertures 356*c*, 356*d* are provided on the other side 3541*b* of the frame. The longitudinal axes of the bores are substantially parallel. Each of the bores receives a respective axle 355*a* in the form of a shaft having threaded end portions. Each of the axles 355*a*, 355*b* extends through a respective one of the bores, and laterally and outwardly relative to each side 3541*a*, 3541*b* of the frame 354. Each of the axles 355*a*, 355*b* is provided to effect rotatable coupling of a respective one of two pairs of wheels 306*a*, 306*b* and 306*c*, 306*d* to the frame 354. The wheels 306*a*, 306*b* and 306*c*, 306*d* facilitate rolling travel of the skate 300 across a reaction surface 502 (see FIG. 21). By virtue of their mounting to the axles 355*a*, 355*b*, the wheels 306*a*, 306*b* are co-axial, and the wheels 306*c*, 306*d* are co-axial. When a skater's first foot is supported on the foot support 302, the axis of rotation of each of the pairs of wheels 306*a*, 306*b* and 306*c*, 306*d* is disposed substantially beneath an operative foot support surface 370 (see below). This positioning of these axes of rotation relative to the skater's first foot, when the skater's first foot is supported on the foot support 302, enables greater directional control of the skate 300 by the skater.

Axle 355*a* effects coupling of the wheel 306*a* laterally adjacent to side 3541*a*, and also effects coupling of wheel 306*b* laterally adjacent to side 3541*b*. Axle 355*b* effects coupling of the wheel 306*c* laterally adjacent to side 3541*a*, and also effects coupling of the wheel 306*d* laterally adjacent to side 3541*b*. Each of the wheels 306*a*, 306*b*, 306*c*, and 306*d* is rotatably coupled to a respective one of the axles 355*a*, 355*b* with a respective one of the bearings 308*a*, 308*b*, 308*c*, 308*d* of a respective one of the wheels 306*a*, 306*b*, 306*c*, and 306*d*. For each wheel 306*a*, 306*b*, 306*c*, and 306*d*, a pair of spacers/washers 309*a*, 309*b* is mounted on the respective axle 355*a*, 355*b*, and one of the spacers/washers 309*a* is disposed between the respective wheel and the frame 354 and the other spacer/washer 309*b* is disposed between the respective wheel and a lock nut 307. The lock nut 307 is threaded on each end of the axles 355*a*, 355*b* in order to keep the wheels 306*a*, 306*b*, 306*c*, and 306*d* coupled to the frame 354.

For example, each of the wheels 306*a*, 306*b*, 306*c*, and 306*d* is a polyurethane roller wheel of the kind used for in-line skates. For example, each of the wheels 306*a*, 306*b*, 306*c*, and 306*d* has a diameter of 72 millimeters. For example, each of the wheels is Kryptonics™ brand, 72 millimeter diameter, 76 A durometer (hardness).

Referring to FIG. 21, each of the wheels 306*a*, 306*b*, 306*c*, and 306*d* is spatially disposed such that, when the skater's first foot 504 is supported on the foot support 302, and the skater 500 is using the skater's second foot 506 to propel the skater 500 across the reaction surface 502 by pushing off the reaction surface 502 with the second foot 506, each of the wheels 306*a*, 306*b*, 306*c*, and 306*d* does not interfere with the skater's second foot 506. To effect this, relative to a foot support and coupling structure 800 including the frame 354, the foot support 302, the foot coupling unit 329, the lateral foot rests 310*a*, 310*b*, and the rear foot rest 320 (see FIG. 23A), each of the wheels 306*a*, 306*b*, 306*c*, and 306*d* is disposed substantially beneath the foot support and coupling structure 800. In this respect, each of the wheels 306*a*, 306*b*, 306*c*, and 306*d* is substantially disposed within a perimeter defined by a plane tangent to the outermost edge 390 of the foot support and coupling structure 800 (see FIG. 23B).

The foot support 302 is coupled to the frame 354. The foot support 302 includes an operative foot support surface 370 for supporting a skater's first foot 504 (see FIG. 21). For example, in the illustrated embodiment, the operative foot support surface 370 is defined, at least in part, by sandpaper grip tape which is adhered to the upper surface of the base 358 of the frame 354, and the remainder of the operative support surface 370, if any, is defined by the base 358 of the frame 354. In other embodiments, the operative support surface 370 may simply be defined by the base 358 of the frame 354. The operative support surface 370 includes a longitudinal axis 3701 (see FIG. 12). When the skate 300 is disposed on the reaction surface 502, the operative foot support surface 370 has a maximum vertical displacement relative to the reaction surface of less than 60 millimeters. For example, the maximum vertical displacement is 58 millimeters.

When the skater's first foot is supported by the operative foot support surface 370, the wall 360 of the frame 354 limits lateral movement of the skater's first foot and protects the skater's foot from coming into contact with external objects such as stones or even splashing water. The toe portion of the skater's first foot is particularly vulnerable to coming into contact with external objects when using the skate 300. In this respect, at least a portion of the front wall 364 includes the functionality of a toe protector, for protecting the toe portion of the skater's first foot from coming into contact with external objects such as stones or even splashing water.

Alternatively, the foot support surface 370 may be defined by a neoprene material adhered to the base 358. When a skater's first foot is positioned on the neoprene material, it is believed that the neoprene material will conform to the shape of the skater's first foot and maintain such shape even after the skater's first foot is removed.

Figure 22:
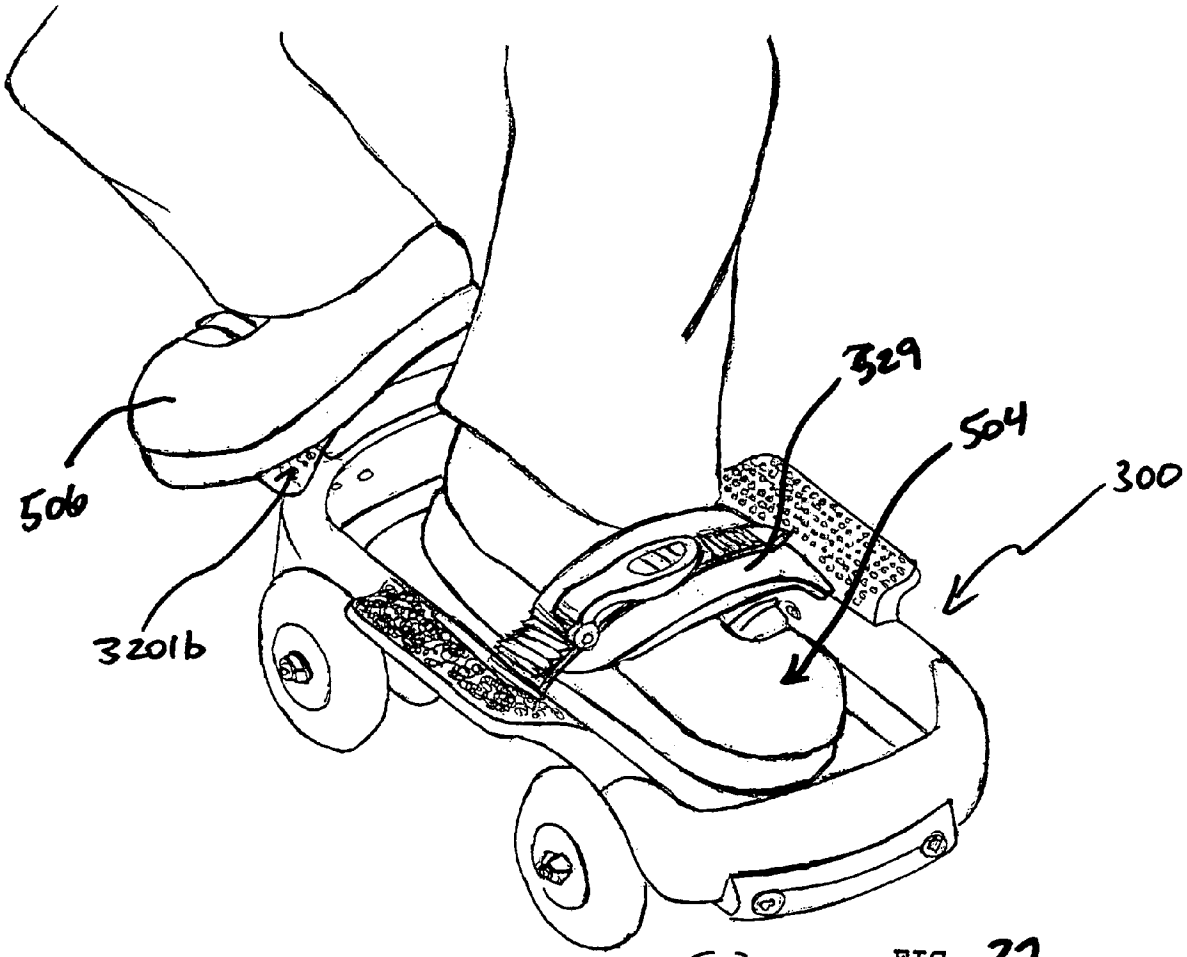
FIG. 22 is a schematic illustration of a skater using the skate of FIG. 12, and particularly illustrating the skater supporting the skater's second foot upon the rear foot rest of the skate.
Figure 23A:
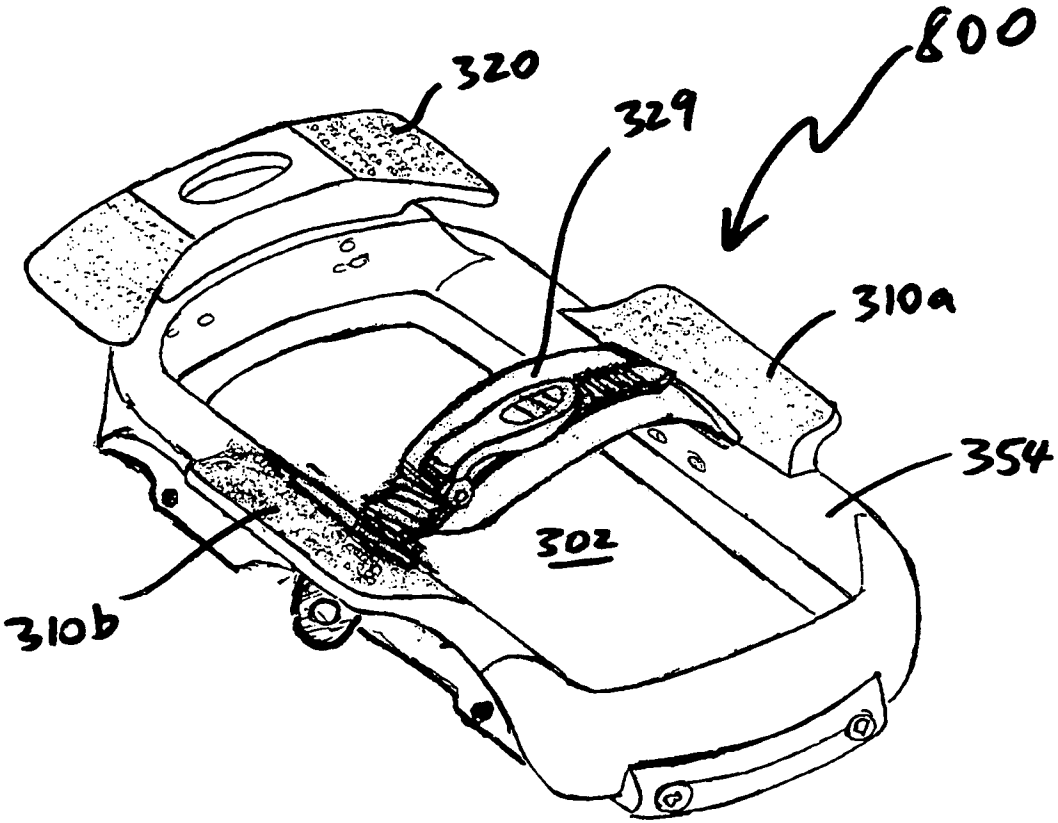
FIG. 23A is a top perspective view of a fragment of the skate of FIG. 12, illustrating the foot support and coupling structure.
Figure 23B:
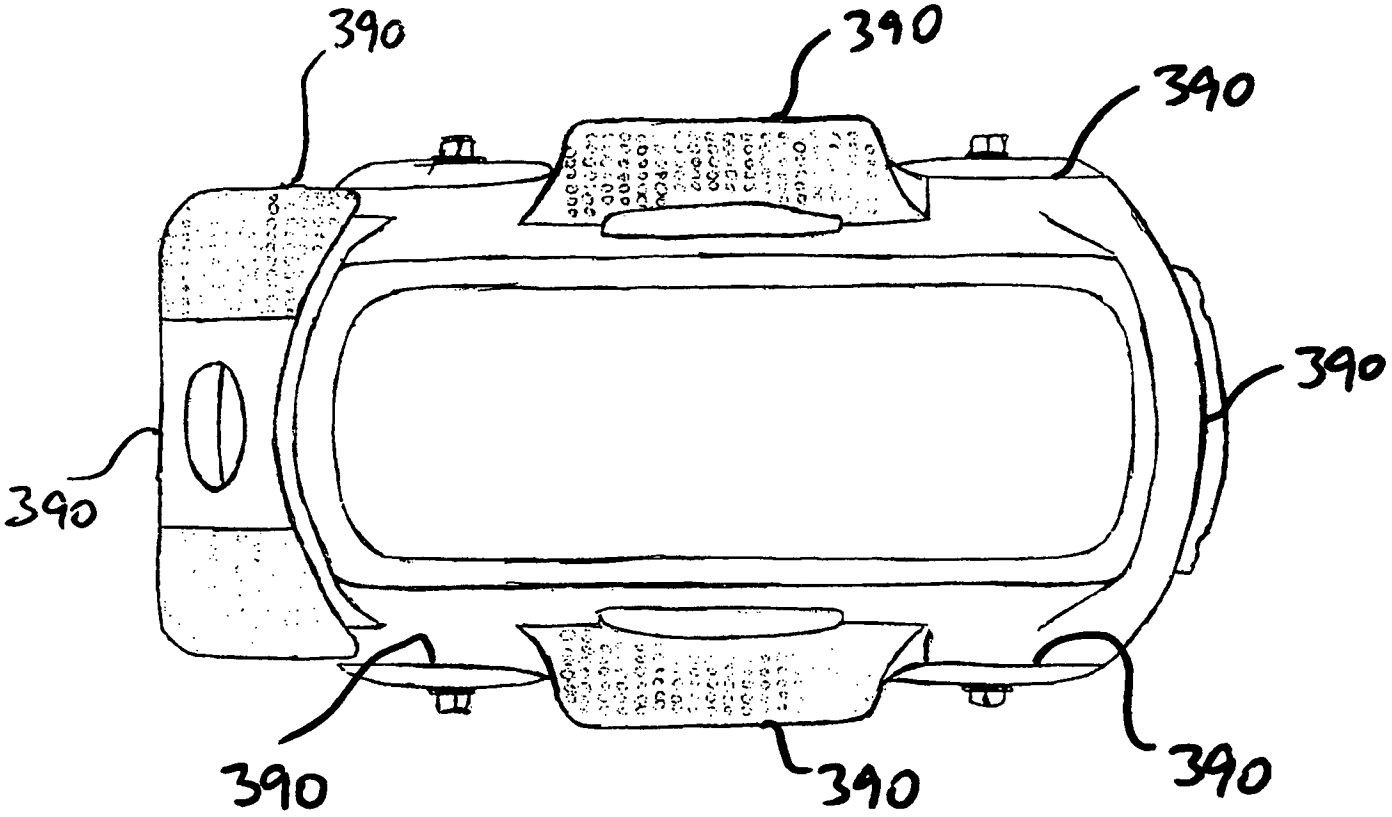
FIG. 23B is a top plan view of the skate of FIG. 12, with the foot coupling unit removed for clarity, illustrating the outer edge of the foot support and coupling structure.
Figure 24:
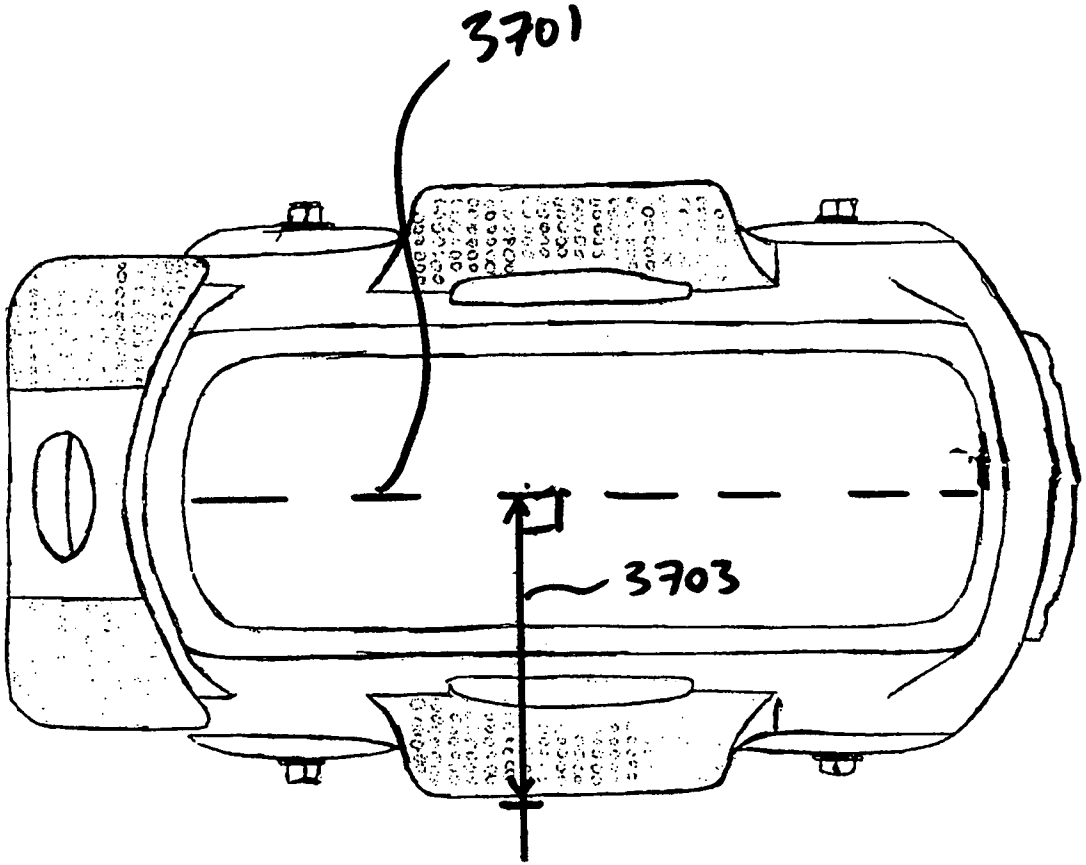
FIG. 24 is a top plan view of the skate of FIG. 12, with the foot coupling unit removed for clarity, illustrating the measurement of the minimum and maximum horizontal distance between the longitudinal axis of the operative foot support surface of the foot support and the outermost edge of a lateral foot rest.

Referring to FIG. 22, the foot coupling unit 329 is configured for coupling the skater's first foot 504 to the operative foot support surface 370 of the foot support 302. In the embodiment illustrated, the foot coupling unit 329 is in the form of a ratchet strap of the conventional type used as bindings in snowboards (see FIGS. 20A and 20B). Referring to FIGS. 14, 15, and 17, each of the sidewalls 362*a*, 362*b* includes a respective one of two sets of three strap positioning holes 3171*a*, 3171*b*, and 3171*c* or 3173*a*, 3173*b*, and 3173*c* (holes 3173*a*, 3173*b*, and 3173*c* for sidewall 362*b* are not shown). One region 3291 of the foot coupling unit 329, such as a ratchet strap, is configured for coupling to one of the positioning holes 3171*a*, 3171*b*, and 3171*c* of sidewall 362*a*, and a second region 3292 of the foot coupling unit 329, spaced apart from the first region 3291, is configured for coupling to one of the positioning holes 3173*a*, 3173*b*, and 3173*c* of the sidewall 362*b*. In this respect, the foot coupling unit 329 is positionable along both sides of the frame 354. Coupling of the foot coupling unit to the positioning holes is effected by screws 3111.

Since the foot coupling unit 329 is, generally, moveable, owing to its pivotal coupling to the frame at the positioning holes, the foot coupling unit 329 has the potential for assuming configurations which are not necessarily optimal for effecting coupling of the first skater's foot to the foot support 302. To mitigate against this, each of the sidewalls 362*a*, 362*b* includes a respective one of two strap insert apertures 303*a*, 303*b* (see FIGS. 12 and 17) for receiving the foot coupling unit 329. The portions of the foot coupling unit 329 received within the apertures 303*a*, 303*b* are disposed on a region of the foot coupling unit 329 which joins the regions 3292, 3292 (which are disposed in respective positioning holes). In this respect, the mobility of the received portions of the foot coupling unit 329 is limited by the apertures 303*a*, 303*b*, and this limited mobility influences positioning of the intermediate region of the foot coupling unit 329 which joins the received portions (and at least a portion of this intermediate region is configured for contacting the skater's first foot) such that a desirable coupling of the skater's first foot to the foot support 302 is more likely to be effected.

Referring to FIGS. 12, 13, 15, 17, and 19, each of a pair of lateral footrests 310*a*, 310*b* extends from the frame 354 on a respective one of opposite sides of the frame 354 and is supported by reinforcement ribs 321 extending from the frame 354. The footrests 310*a*, 310*b* are substantially mirror images of each other. Each of the footrests 310*a*, 310*b* has a respective one of outermost edges 3111*a*, 3111*b*. The maximum horizontal distance between the longitudinal axis 3701 and each of the outermost edges 3111*a*, 3111*b* is less than 140 millimeters, wherein the maximum distance is measured along a plane (such as plane 3703) to which the longitudinal axis 3701 is normal (see FIG. 24). For example, the maximum horizontal distance is 118 millimeters.

Figure 16:
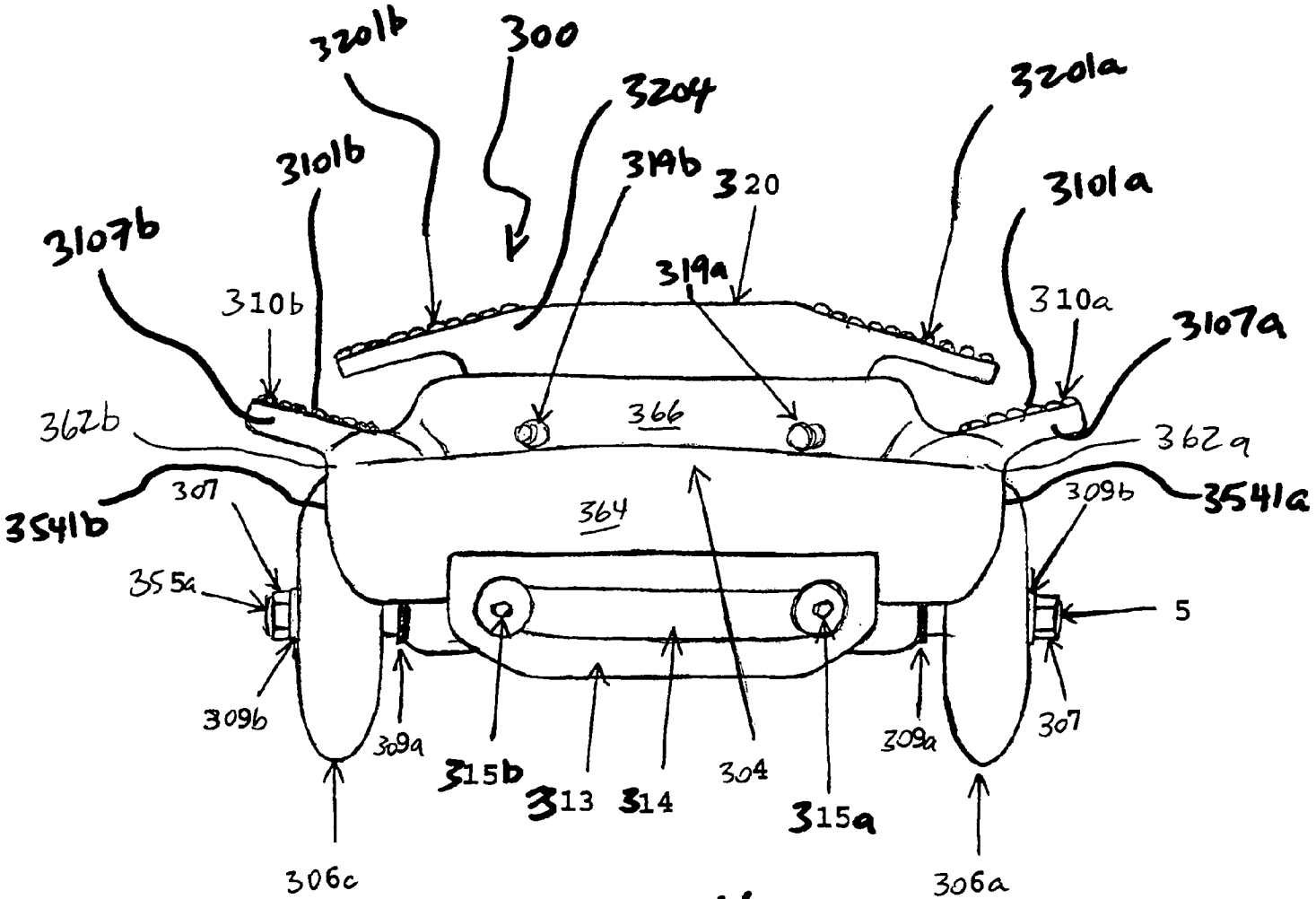
FIG. 16 is a front elevation view of the skate of FIG. 12, with the foot coupling unit removed for clarity.
Figure 18:
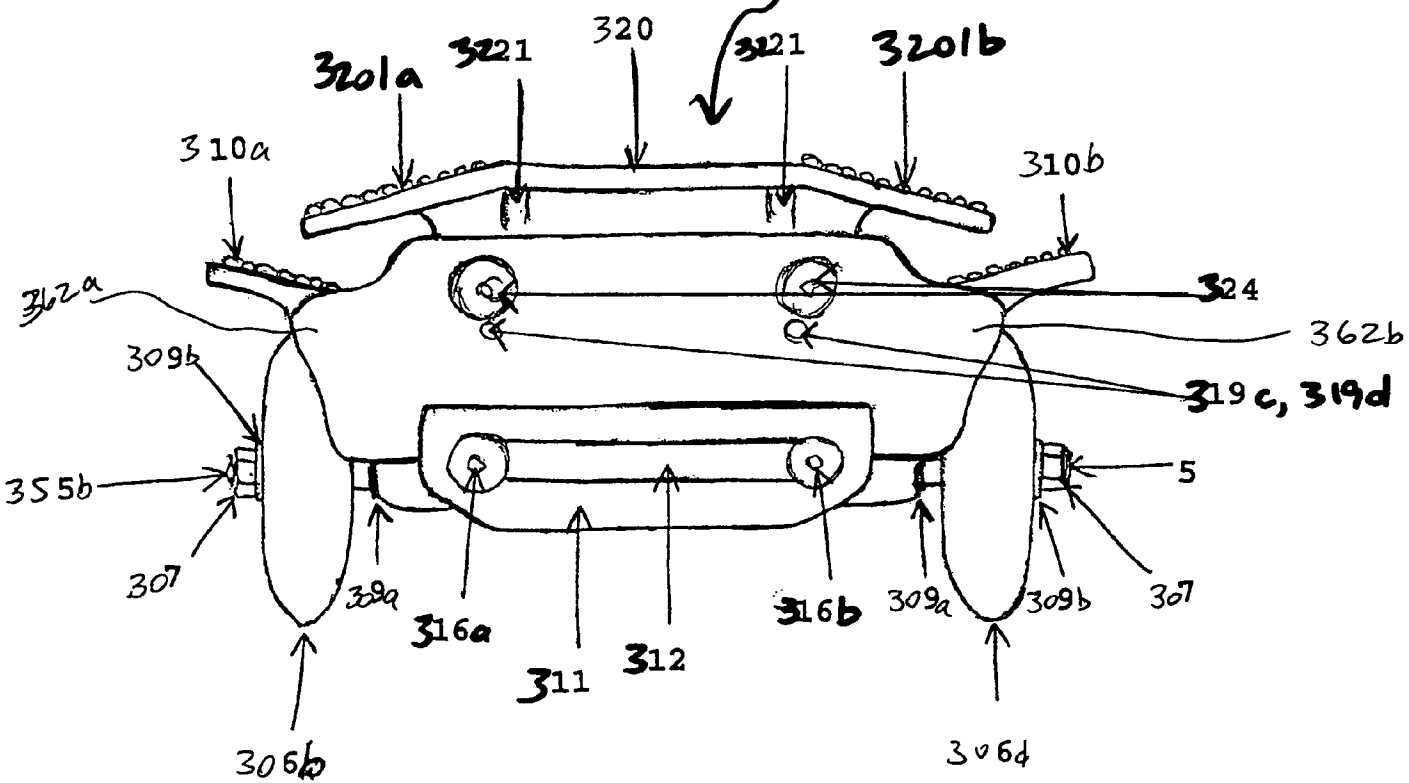
FIG. 18 is a rear elevation view of the skate of FIG. 12, with the foot coupling unit removed for clarity.
Figure 19:
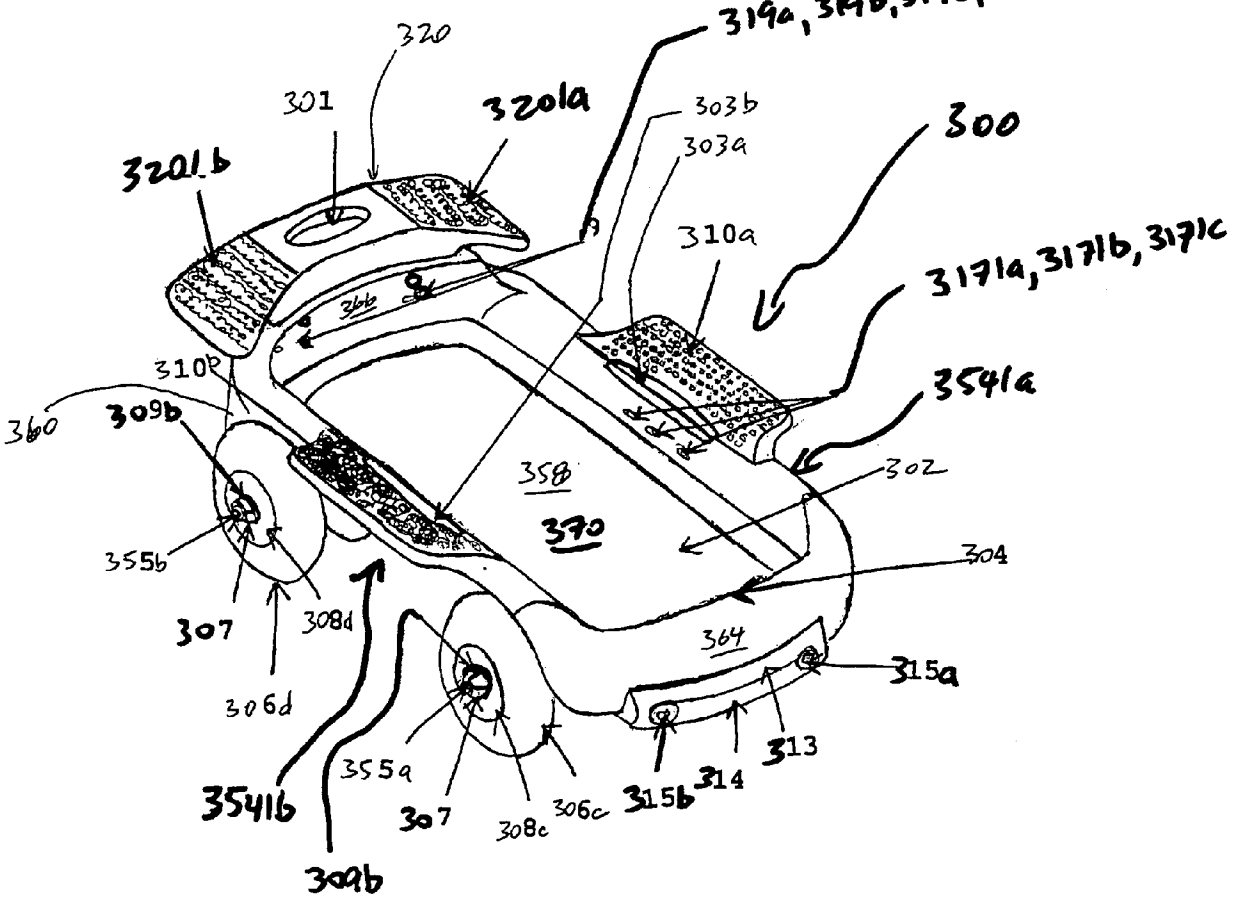
FIG. 19 is a top perspective view of the skate of FIG. 12, with the foot coupling unit removed for clarity.
Figure 20B:
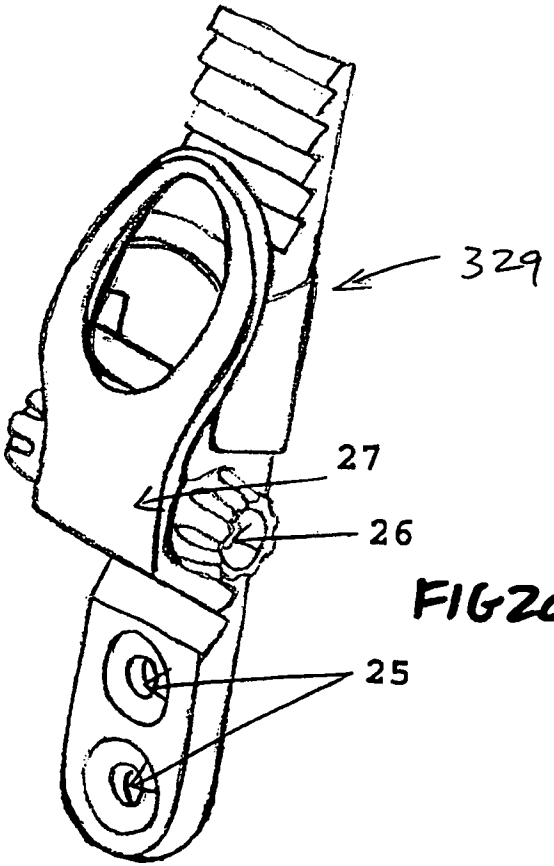
FIGS. 20A and 20B illustrate suitable foot coupling units for use in the skate of FIG. 12.
Figure 20A:
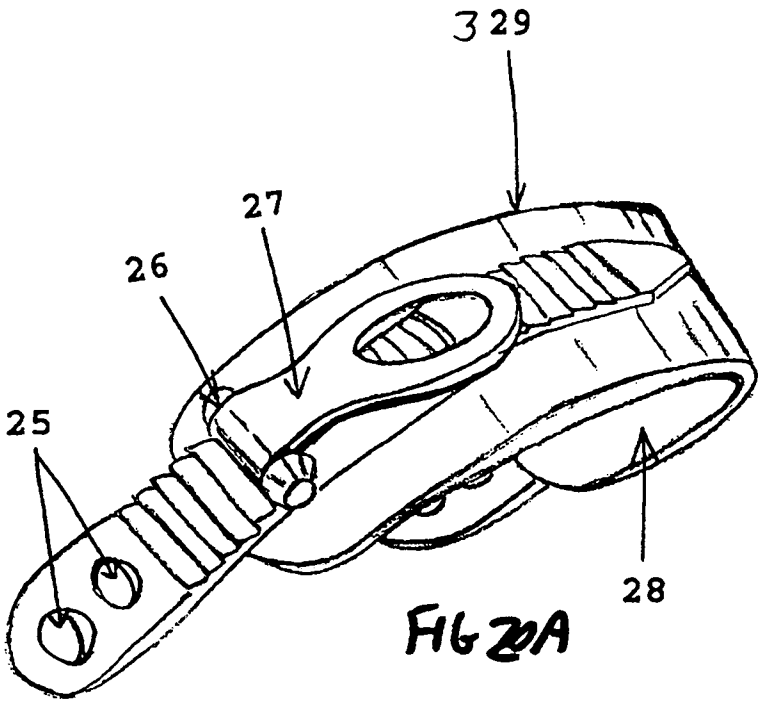

Referring to FIGS. 16 and 18, each of the footrests 310*a*, 310*b* includes a respective one of footrest members 3107*a*, 3107*b*. Each of the footrest members 3107*a*, 3107*b* extends laterally from a respective one of the sidewalls 362*a*, 3262*b*. Each of the footrests 310*a*, 310*b* also includes a respective one of operative foot rest support surfaces 3101*a*, 3101*b* coupled to a respective one of the footrest members 3107*a*, 3107*b*. Each of the operative foot rest support surfaces 3101*a*, 3101*b* is configured for supporting the skater's second foot when the skater's first foot is supported by the foot support 302 and coupled to the foot support 302 by the foot coupling unit 329. For example, each of the operative foot rest support surfaces 3101*a*, 3101*b* is defined, at least in part, by adhesive sandpaper grip tape, and each remaining surface of a respective one of the support surfaces 3101*a*, 3101*b*, if any, is integrally formed with a respective one of the sidewalls 362*a*, 362*b*. In other embodiments, the entirety of each of the support surfaces 3101*a*, 3101*b* may simply be formed integrally with a respective one of the sidewalls 362*a*, 362*b*. Such integral forming may be effected by injection molding.

Each of the operative foot rest support surfaces 3101*a*, 3101*b* is disposed above the reaction surface 502 by a minimum vertical distance of at least 80 millimeters. For example, the minimum vertical distance is 90 millimeters.

Each of the operative foot rest support surfaces 3101*a*, 3101*b* is disposed above the operative foot support surface 370 by a minimum vertical distance of at least 32 millimeters. For example, the minimum vertical distance is 42 millimeters.

Figure 25:
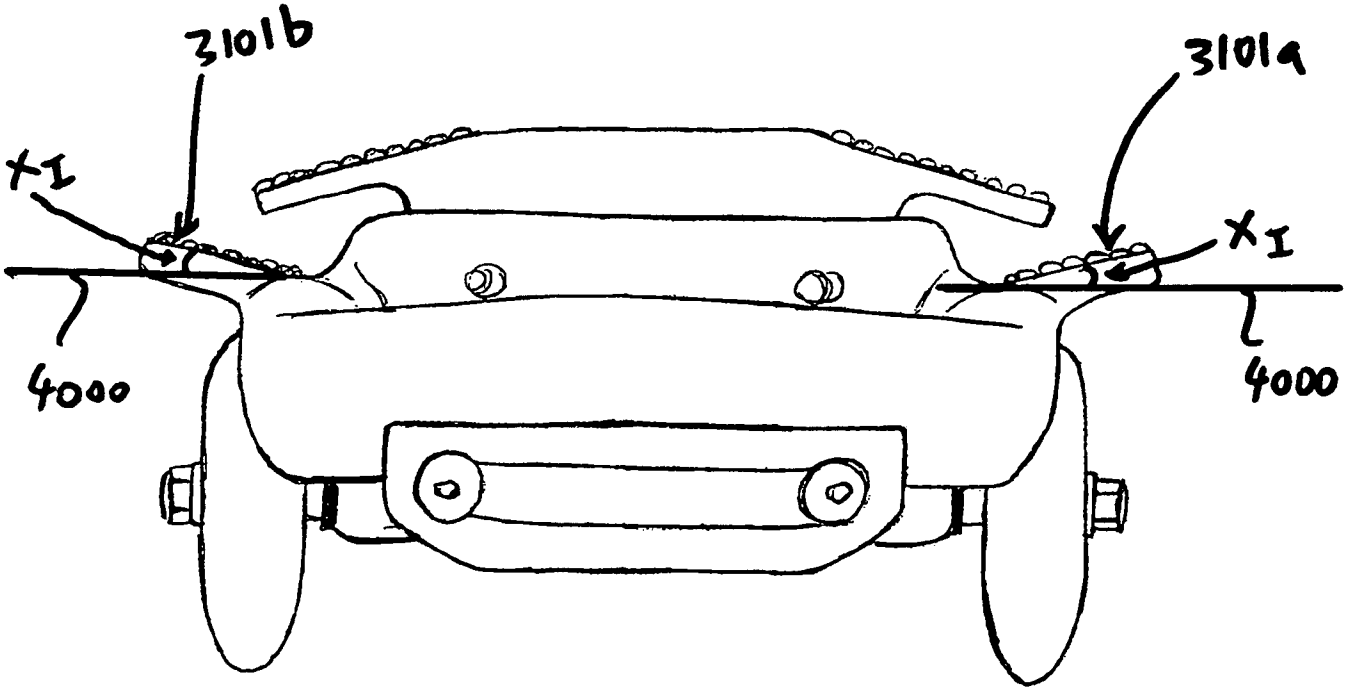
FIG. 25 is a front elevation view of the skate of FIG. 12, with the foot coupling unit removed for clarity, illustrating the measurement of an inclination angle of the lateral foot rests.

Each of the operative foot rest support surfaces 3101*a*, 3101*b* has a minimum angle of inclination $X_1$ above a horizontal plane (such as horizontal plane 4000) of at least 10 degrees relative to the horizontal plane, and also has a maximum angle of inclination $X_1$ above a horizontal plane (such as horizontal plane 4000) of less than 18 degrees relative to the horizontal plane 4000 (see FIG. 25). For example, each of the minimum and maximum angles of inclination above a horizontal plane is about the same. For example, each of these angles is the same, and is 15 degrees.

Figure 26A:
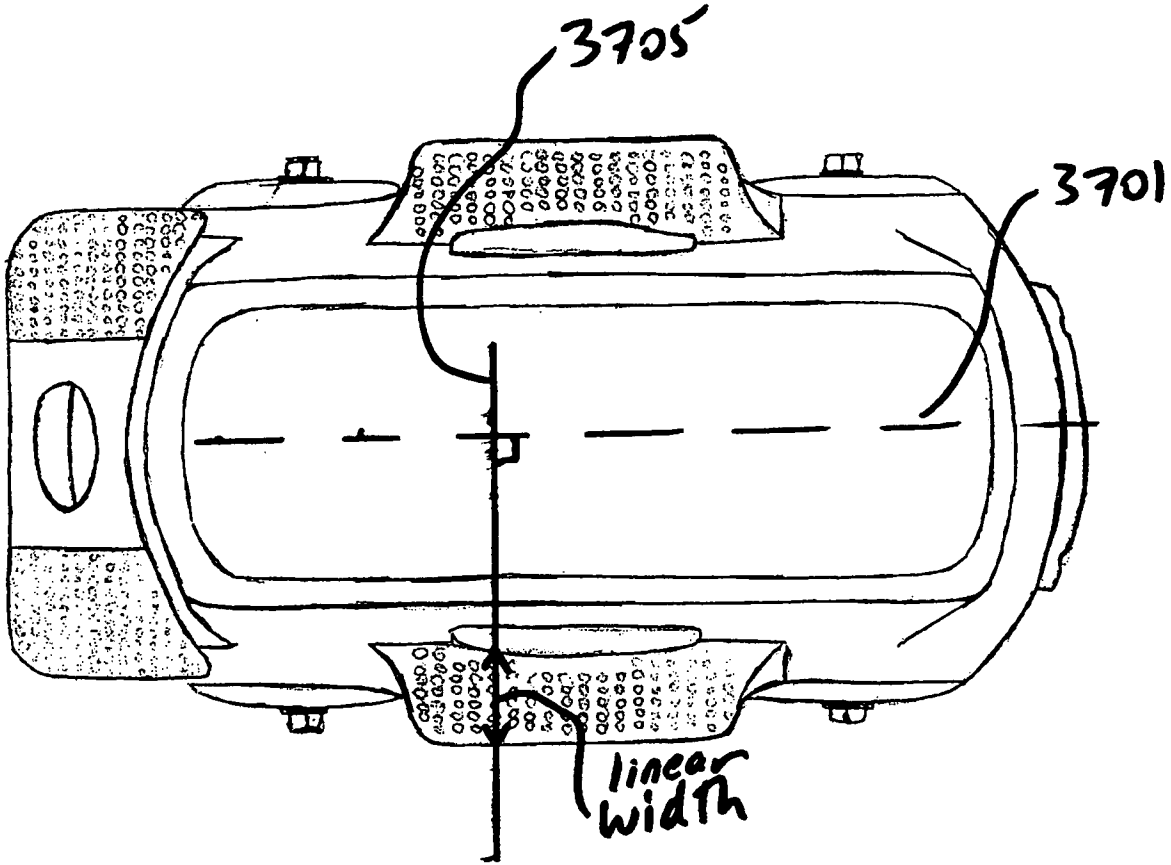
FIG. 26A is a top plan view of the skate of FIG. 12, with the foot coupling unit removed for clarity, illustrating the measurement of the minimum and maximum linear widths of a lateral foot rest.
Figure 26B:
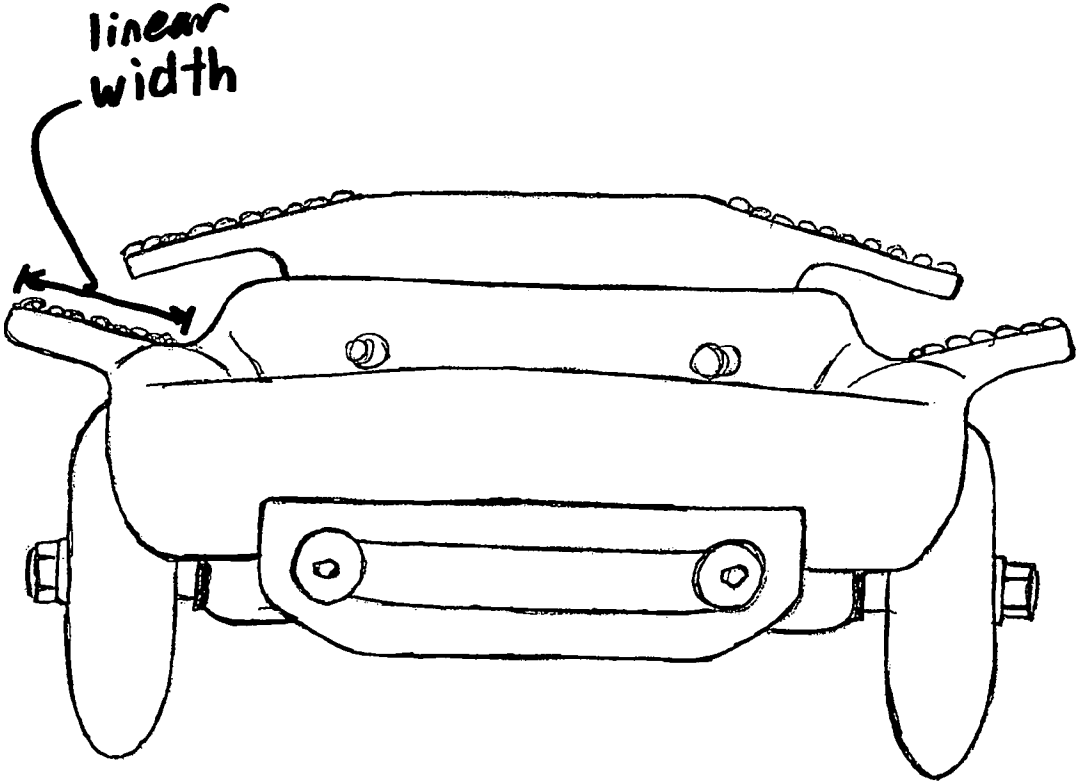
FIG. 26B is a front elevation view of the skate of FIG. 12, with the foot coupling unit removed for clarity, further illustrating the measurement of the minimum and maximum linear widths of a lateral foot rest.

Each of the operative foot rest support surfaces 3101*a*, 3101*b* has a minimum linear width of at least 30 millimeters, and a maximum linear width of less than 45 millimeters, wherein each of the minimum linear width and the maximum width is measured along a plane (such as plane 3705) to which the longitudinal axis 3701 is normal (see FIG. 26). For example, each of the minimum and maximum linear width is about the same. For example, each of the minimum linear width and the maximum linear width is the same, and is 35.5 millimeters.

Each of the operative foot rest support surfaces 3101*a*, 3101*b* has a surface area of at least 2800 millimeters$^2$. For example, each of the operative foot rest support surfaces 3101*a*, 3101*b* has a surface area of 3135 millimeters$^2$.

Referring to FIGS. 12, 15, 17, 18, and 19, the rear footrest 320 extends upwardly from the rear wall 366. The rear foot rest includes an upstanding member 3203 and a cross member 3204. The cross member 3204 extends from the upper region of the upstanding member 3203, and includes spaced-apart operative foot rest support surfaces 3201*a*, 3201*b* and an intermediate element 3205 disposed between the foot surfaces 3201*a*, 3201*b*. The cross member 3204 is supported by ribs 3221 extending from the frame 354.

Referring to FIG. 17, in this embodiment, the rear foot rest 320 is provided as a structure which is formed independently of the frame 354. The rear foot rest 320 is inserted into a slot 318 provided in the rear wall 366. A pair of spaced-apart rear wall position holes 322*a*, 322*b* are provided in the rear wall 366. Two sets of spaced apart foot rest position holes 319*a*, 319*b* and 319*c*, 319*d* are provided in the rear foot rest. Position holes 319*a*, 319*b* are disposed vertically above the position holes 319*c*, 319*d*. To couple the footrest 320 to the rear wall 366, one of the two sets of spaced apart foot rest position holes 319*a*, 319*b* or 319*c*, 319*d* is aligned with the rear wall position holes, and a fastener 324 (such as a bolt) is inserted through the aligned holes to effect coupling of the foot rest 320 to the rear wall 366 (where the fastener is a bolt, then a nut is threaded onto the free end of the bolt to effect the coupling). Because the rear footrest 320 is provided with two sets of positioning holes, one set being disposed vertically higher than the other set, the rear footrest 320 is vertically adjustable relative to the rear wall 366.

Each of the support surfaces 3201*a*, 3201*b* is configured for supporting the skater's second foot when the skater's first foot is supported by the foot support 302 and coupled to the foot support 302 by the foot coupling unit 329. FIG. 22 illustrates support of the skater's second foot 506 by the surface 3201*b*. Each of the support surfaces 3201*a*, 3201*b* is defined, at least in part, by sandpaper grip tape. Each of the operative foot rest support surfaces 3201*a*, 3201*b* is disposed above the reaction surface by a minimum vertical distance of at least 110 millimeters. For example, the minimum vertical distance is 120 millimeters.

Each of the operative foot rest support surfaces 3201*a*, 3201*b* is disposed above the operative foot support surface 370 by a minimum vertical distance of at least 42 millimeters. For example, the minimum vertical distance is 52 millimeters.

Figure 27:
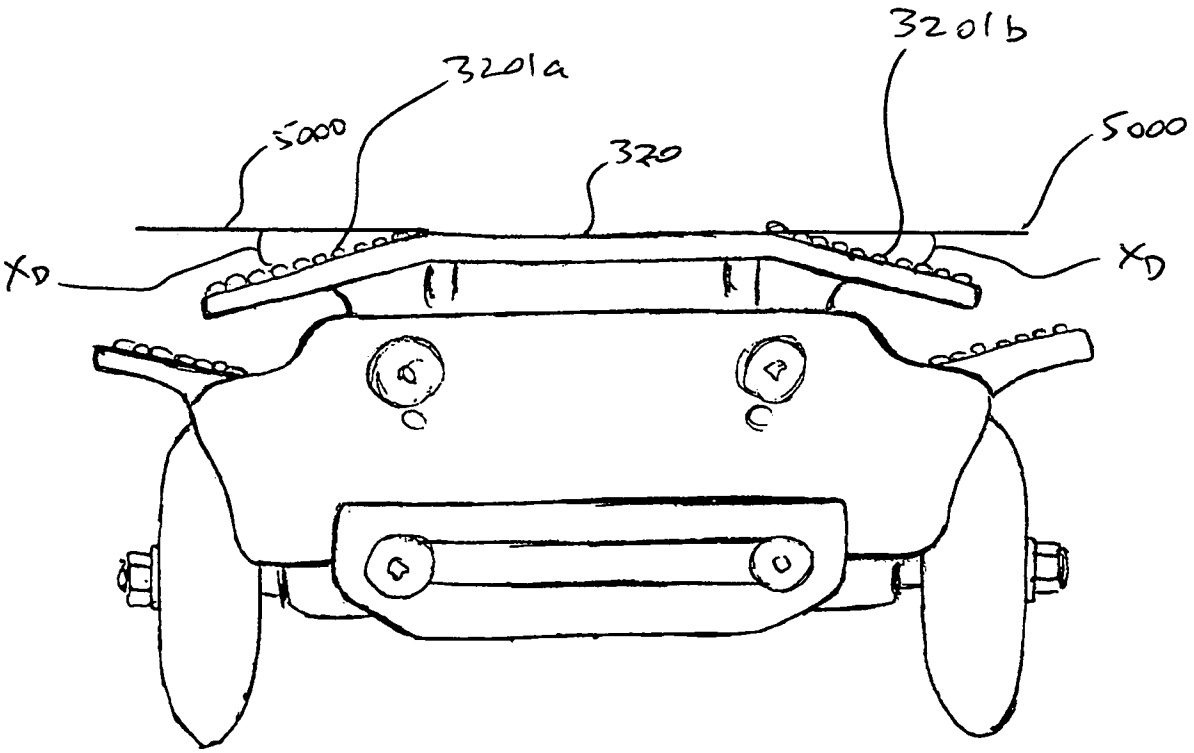
FIG. 27 is a rear elevation view of the skate of FIG. 12, with the foot coupling unit removed for clarity, illustrating the measurement of a declination angle of the rear foot rest.

Each of the operative foot rest surfaces 3201*a*, 3201*b* has a minimum angle of declination below a horizontal plane (such as horizontal plane 5000) of at least 5 degrees relative to the horizontal plane, and also has a maximum angle of declination below a horizontal plane (such as horizontal plane 5000) of less than 25 degrees relative to the horizontal plane (see FIG. 27). For example, the minimum and maximum angle of inclination above a horizontal plane is about the same. For example, each of the minimum and maximum angles of inclination is the same, and it is 15 degrees.

With respect to the rear foot rest 320, each of the operative foot rest support surfaces 3201*a*, 3201*b* has surface area of at least 1805 millimeters$^2$. For example, each of the operative foot rest support surfaces 3201*a*, 3201*b* has a surface area of 2029 millimeters$^2$.

The intermediate element 3205 of the rear footrest 320 also includes a hole 301 configured to permit insertion of a human finger to effect support of the skate by a human finger. The hole 301 has a substantially vertical axis. The skate 100 can be carried by a human finger when the skate 100 is not in use. In this respect, the footrest 320 also functions as a carrying tab.

The lateral foot rest operative foot rest support surface 3101*a* and the rear foot rest operative foot rest support surface 3201*a* are disposed relative to one another such that, when the skater's first foot is supported by the foot support 302 and coupled to the foot support 302 by foot coupling unit 329, the skater's second foot can be positioned upon and be simultaneously supported by both the lateral foot rest operative foot rest support surface 3101*a* and the rear foot rest operative foot support surface 3201*a*. The lateral foot rest operative foot rest support surface 3101*b* and the rear foot rest operative foot rest support surface 3201*b* are disposed relative to one another such that, when the skater's first foot is supported by the foot support 302 and coupled to the foot support 302 by foot coupling unit 329, the skater's second foot can be positioned upon and be simultaneously supported by both the lateral foot rest operative foot rest support surface 3101*b* and the rear foot rest operative foot rest support surface 3201*b*.

Referring to FIGS. 13, 14, 15, and 18, the skate 300 includes rear and front brakes 311, 313. The rear brake 311 is coupled to a rear end 372 of the frame 354. In this respect, the rear brake 311 is disposed within a recess 3721 provided within the rear end 372 of the frame 354. To effect coupling of the brake 311 to the frame 354 within this recess 3721, the rear brake 311 is fastened to the rear end 372 of the frame with bolts 316*a*, 316*b* threaded through a respective one of brake bores 3222*a*, 3222*b* and frame bores (not shown). The front brake 313 is coupled to the front end 374 of the frame 354. In this respect, the front brake 313 is disposed within a recess 3741 provided within the front end 374 of the frame 354. To effect coupling of the brake 313 to the frame 354 within this recess 3741, the front brake 313 is fastened to the front end 374 of the frame with bolts 315*a*, 315*b* threaded through a respective one of brake bores 3221*a*, 3221*b* and frame bores 322*a*, 322*b*. The front surface of each of the brakes 311, 313 includes a respective one of the reflectors 312, 314 for reflecting light and thereby illuminating the skate 300 during poor visibility.

Each of the brakes 311, 313 includes a respective braking surface which is configured to effect frictional resistance to movement of the skate 300 when the skater shifts his or her body weight so as to cause the respective braking surface to come into frictional engagement with the reaction surface upon which the skate 300 is travelling. The braking surface of each of the brakes 311, 313 has a minimum width of at least 80 millimeters measured along a horizontal plane. For example, the minimum width is 120 millimeters. The braking surface of each of the brakes 311, 313 includes two spaced apart lower edges 380*a*, 380*b* which are chamfered. For example, the braking surface is made of vulcanized rubber. For example, each of the brake is made by overmolding a metal plate with vulcanized rubber to effect reinforcement of the brake.

Each of the front and rear brakes 313, 311 also includes a respective one of reflector surfaces 314, 312. For example, each of the reflector surfaces 314, 312 is reflector tape adhered to the braking surface of a respective one of the brakes 313, 311.

Referring to FIG. 14, it is contemplated to provide light emitting diodes coupled to a front end 374 the frame 34 at the regions 3100*a*, 3100*b*. The diodes function as lights for improving visibility in circumstances where visibility is not optimal. It is envisioned to supply power is supplied to each of the diodes with a respective battery. It is contemplated that each of the diode and battery combinations could be inserted within a slot formed within the front end 374 of the frame 354, and could be mounted within the slot by press fitting the combination within the slot or mounting a transparent or translucent plate to the front end 374 of the frame 354 while covering the slot.

It will be understood, of course, that modifications can be made in the embodiments of the invention described herein without departing from the scope and purview of the invention as defined by the appended claims.

What is claimed is:

1. A skate comprising:

a frame;

a plurality of wheels rotatably coupled to the frame;

a foot support coupled to the frame, and including an operative foot support surface configured for supporting a skater's first foot, wherein the operative foot support surface includes a longitudinal axis;

a foot coupling unit coupled to the frame, and configured for coupling the skater's first foot to the operative foot support surface;

first, second, and third sidewall portions projecting above the foot support, the first and the second sidewall portions are on opposite sides of the foot support;

a first lateral foot rest extending from the first sidewall portion and a second lateral foot rest extending from the second sidewall portion, the first and the second lateral foot rests extending outward in opposite directions;

a rear foot rest extending from the third sidewall portion rearwardly relative to the foot support, and including an operative foot rest support surface configured for supporting the skater's second foot when the skater's first foot is supported by and coupled to the operative foot support surface;

wherein the first and second lateral foot rests and the rear foot rest are disposed relative to one another such that, when the skater's first foot is supported by and coupled to the foot support, the skater's second foot can be positioned upon and be simultaneously supported by both the rear foot rest and one of the first and second lateral foot rests.

2. The skate as claimed in claim 1, wherein the operative foot rest support surface is disposed above the operative foot support surface by a minimum vertical distance of at least 32 millimeters.

3. The skate as claimed in claim 1, wherein the operative foot rest support surface includes a minimum angle of inclination above a horizontal plane of at least 10 degrees relative to the horizontal plane, and also includes a maximum angle of inclination above a horizontal plane of less than 18 degrees relative to the horizontal plane.

4. The skate as claimed in claim 1, wherein a maximum horizontal distance between the longitudinal axis and an outermost edge of the one of the first or second lateral foot rests is less than 140 millimeters, and wherein the maximum horizontal distance is measured along a plane to which the longitudinal axis is normal.

5. The skate as claimed in claim 1, wherein each of the wheels includes an axis of rotation, and the respective axis of rotation of each of the wheels is disposed substantially beneath the operative foot support surface.

6. The skate as claimed in claim 5, wherein the wheels include a front pair of wheels sharing a first common axis of rotation and a rear pair of wheels sharing a second common axis of rotation, such that each of the first common axis of rotation and the second common axis of rotation is disposed substantially beneath the operative foot support surface.

7. The skate as claimed in claim 1, wherein the operative foot support surface is disposed above a reaction surface by a maximum vertical distance of less than 60 millimeters.

8. A skate comprising:

a frame;

a plurality of wheels rotatably coupled to the frame and configured to effect rolling motion of the skate across a reaction surface;

a foot support coupled to the frame, and including an operative foot support surface configured for supporting a skater's first foot, wherein the operative foot support surface includes a longitudinal axis;

a foot coupling unit coupled to the frame, and configured for coupling the skater's first foot to the operative foot support surface; and a footrest extending from a sidewall for supporting the skater's second foot, the foot rest including a first portion extending rearward relative to the foot support, a second portion extending laterally relative to the foot support, and a third portion extending laterally relative to the foot support, the second and third portions are opposite to one another and extend outward in opposite directions;

wherein the skater's second foot can be positioned upon and simultaneously supported by both the first portion and one of the second and third portions of the foot rest.

9. The skate as claimed in claim 8, wherein the foot rest is disposed above the operative foot support surface by a minimum vertical distance of at least 32 millimeters.

10. The skate as claimed in claim 8, wherein each of the wheels includes an axis of rotation, and the respective axis of rotation of each of the wheels is disposed substantially beneath the operative foot support surface.

11. The skate as claimed in claim 10, wherein the wheels include a front pair of wheels sharing a first common axis of rotation and a rear pair of wheels sharing a second common axis of rotation, such that each of the first common axis of rotation and the second common axis of rotation is disposed substantially beneath the operative foot support surface.

12. The skate as claimed in claim 8, wherein the operative foot support surface is disposed above the reaction surface by a maximum vertical distance of less than 60 millimeters.

13. A skate comprising:

a frame;

a plurality of wheels rotatably coupled to the frame;

a foot support coupled to the frame, and configured for supporting a skater's first foot;

a foot coupling unit coupled to the frame, and configured for coupling the skater's first foot to the foot support;

first, second, and third sidewall portions projecting above the foot support, the first and the second sidewall portions are on opposite sides of the foot support;

a first lateral foot rest extending from the first sidewall portion and a second lateral foot rest extending from the second sidewall portion, the first and the second sidewall portions extending outward in opposite directions; and a rear foot rest extending from the third sidewall portion, and disposed rearwardly relative to the foot support;

wherein the first lateral foot rest, the second lateral foot rest, and the rear foot rest are disposed relative to one another such that, when the skater's first foot is supported by and coupled to the foot support, the skater's second foot can be positioned upon and be simultaneously supported by both the rear foot rest and one of the first or second lateral foot rests.

14. The skate as claimed in claim 13, wherein each of the first and second sidewall portions is configured to limit movement of the skater's first foot when the skater's first foot is supported by and coupled to the foot support.

15. The skate of claim 13, wherein the frame includes a continuous sidewall projecting above the foot support, and the continuous sidewall includes the first and second sidewall portions.

16. A skate comprising:

a main body;

a plurality of wheels rotatably coupled to the main body and configured to effect rolling motion of the skate across a reaction surface;

a foot support coupled to the main body, and including an operative foot support surface configured for supporting a skater's first foot;

first, second, and third sidewall portions projecting above the foot support, the first and the second sidewall portions are on opposite sides of the foot support;

a foot coupling unit coupled to the main body, and configured for coupling the skater's first foot to the operative foot support surface; and a foot rest extending from the sidewall portions for supporting the skater's second foot, the foot rest including a first portion extending rearward relative to the primary foot support, a second portion extending laterally relative to the primary foot support, and a third portion extending laterally relative to the foot support, the second and third portions are opposite to one another and extend outward in opposite directions;

wherein the skater's second foot can be positioned upon and simultaneously supported by both the first portion and one of the second and third portions of the foot rest.

17. The skate as claimed in claim 16, wherein at least one of the foot rest portions is disposed above the reaction surface by a minimum vertical distance of at least 80 milimeters.

18. The skate as claimed in claim 16, wherein at least one of the foot rest portions is disposed above the operative foot support surface by a minimum distance of at least 32 milimeters.

19. The skate as claimed in claim 16, wherein each of the wheels includes an axis of rotation, and the respective axis of rotation of each of the wheels is disposed substantially beneath the operative foot support surface.

20. The skate as claimed in claim 19, wherein the wheels include a front pair of wheels sharing a first common axis of rotation and a rear pair of wheels sharing a second common axis of rotation, such that each of the first common axis of rotation and the second common axis of rotation is disposed substantially beneath the operative foot support surface.

21. The skate as claimed in claim 16, wherein the operative foot support surface is disposed above the reaction surface by a maximum vertical distance of less than 60 millimeters.

22. A skate comprising:

a main body;

a plurality of wheels rotatably coupled to the main body;

a foot support of the main body configured for supporting a skater's foot;

a foot coupling unit coupled to the main body, and configured for coupling the skater's foot;

first, second, and third sidewall portions projecting above the foot support, the first and the second sidewall portions are on opposite sides of the foot support;

a first lateral foot rest extending from the first sidewall portion and a second lateral foot rest extending from the second sidewall portion, the first and the second sidewall portions extending outward in opposite directions;

a rear foot rest extending from the third sidewall portion, and disposed rearwardly relative to the foot support; and a brake coupled to an undersurface of the main body of the frame and including a braking surface;

wherein the first and the second lateral foot rests and the rear foot rest are disposed relative to one another such that, when the skater's first foot is supported by and coupled to the foot support, the skater's second foot can be positioned upon and be simultaneously supported by both the rear foot rest and one of the first and second lateral foot rests.

23. A skate comprising:

a main body;

a plurality of wheels rotatably coupled to the main body;

a foot support of the main body, and configured for supporting a skater's foot;

a foot coupling unit coupled to the main body, and configured for coupling the skater's foot to the foot support;

a carrying tab extending from the main body, and including a hole configured to permit insertion of a human finger to effect support of the skate by the human finger;

first, second, and third sidewall portions projecting above the foot support, the first and the second sidewall portions are on opposite sides of the foot support;

a first lateral foot rest extending from the first sidewall portion and a second lateral foot rest extending from the second sidewall portion, the first and the second sidewall portions extending outward in opposite directions; and a rear foot rest extending from the third sidewall portion rearwardly relative to the foot support;

wherein the first and second lateral foot rests and the rear foot rest are disposed relative to one another such that, when the skater's first foot is supported by and coupled to the foot support, the skater's second foot can be positioned upon and be simultaneously supported by both the rear foot rest and one of the first and second lateral foot rests.

24. The skate as claimed in 23, wherein the carrying tab is disposed rearwardly of the foot support and is configured for limiting rearward movement of the skater's foot when supported by and coupled to the foot support.

25. A skate comprising:

a main body including a base and an upwardly extending sidewall extending upwardly from the base;

a plurality of wheels rotatably coupled to the main body and configured to effect rolling motion of the skate across a reaction surface;

a foot support of the main body, and configured for supporting a skater's first foot; and a foot rest, extending from the sidewall, and configured for supporting the skater's second foot when the skater's first foot is supported by the foot support, the foot rest including a first portion extending rearward relative to the foot support, a second portion extending laterally relative to the foot support, and a third portion extending laterally relative to the foot support, the second and third portions are opposite to one another and extend outward in opposite directions;

wherein the skater's second foot can be positioned upon and be simultaneously supported by both the first portion and one of the second and third portions of the foot rest.

26. The skate as claimed in claim 25, wherein the upwardly extending sidewall is a continuous sidewall, and the foot support is disposed within the continuous sidewall.

27. The skate as claimed in claim 25, wherein the upwardly extending sidewall is configured for limiting movement of the skater's first foot when supported by the foot support.

28. The skate as claimed in claim 25, further comprising a foot coupling unit coupled to the main body, and configured for coupling the skater's first foot to the foot support.

29. A skate comprising:

a frame;

a plurality of wheels rotatably coupled to the frame and configured to effect rolling motion of the skate across a reaction surface;

a foot support coupled to the frame, and including an operative foot support surface configured for supporting a skater's first foot;

a foot coupling unit coupled to the frame, and configured for coupling the skater's first foot to the operative foot support surface;

first, second, and third sidewall portions projecting above the foot support, the first and the second sidewall portions are on opposite sides of the foot support;

a first lateral foot rest extending from the first sidewall portion and a second lateral foot rest extending from the second sidewall portion, the first and the second lateral foot rests extending outward in opposite directions;

a rear foot rest, extending from the third sidewall portion rearwardly relative to the foot support, and including an operative foot rest support surface configured for supporting the skater's second foot when the skater's first foot is supported by and coupled to the operative foot support surface;

wherein the first and second lateral foot rests and the rear foot rest are disposed relative to one another such that, when the skater's first foot is supported by and coupled to the foot support, the skater's second foot can be positioned upon and be simultaneously supported by both the rear foot rest and one of the first and second lateral foot rests; and wherein the operative foot rest support surface is disposed above the reaction surface by a minimum vertical distance of at least 80 millimeters.

30. The skate as claimed in claim 29, wherein the operative foot rest support surface is disposed above the operative foot support surface by a minimum vertical distance of at least 32 millimeters.

31. The skate as claimed in claim 29, wherein each of the wheels includes an axis of rotation, and the respective axis of rotation of each of the wheels is disposed substantially beneath the operative foot support surface.

32. The skate as claimed in claim 31, wherein the wheels include a front pair of wheels sharing a first common axis of rotation and a rear pair of wheels sharing a second common axis of rotation, such that each of the first common axis of rotation and the second common axis of rotation is disposed substantially beneath the operative foot support surface.

33. The skate as claimed in claim 29, wherein the operative foot support surface is disposed above the reaction surface by a maximum vertical distance of less than 60 millimeters.

34. A skate comprising:

a main body;

a foot support of the main body including an operative foot support surface configured for supporting a skater's first foot, wherein the operative foot support surface includes a longitudinal axis; and a foot rest extending from a sidewall of the main body for supporting the skater's second foot, the foot rest including a first portion extending rearward relative to the foot support, a second portion extending laterally relative to the foot support, and a third portion extending laterally relative to the foot support, the second and third portions are opposite to one another and extend outward in opposite directions; and a plurality of wheels rotatably coupled to the main body;

wherein each of the wheels is disposed substantially beneath the foot support; and wherein the skater's second foot can be positioned upon and simultaneously supported by both the first portion and one of the second or third portions of the foot rest.

35. The skate as claimed in claim 34, further comprising a foot coupling unit coupled to the frame and configured for coupling the skater's first foot to the operative foot support surface.

36. A skate comprising:

a main body;

a plurality of wheels rotatably coupled to the main body;

a primary foot support configured to support a skater's first foot;

a sidewall projecting above the primary foot support; and a foot rest extending from the sidewall for supporting the skater's second foot, the foot rest including a first portion extending rearward relative to the primary foot support, a second portion extending laterally relative to the primary foot support, and a third portion extending laterally relative to the primary foot support, the second and third portions are opposite to one another;

wherein the foot rest is configured such that the skater's second foot can be positioned upon and be simultaneously supported by both the first portion and one of the second and the third portions of the foot rest.

37. The skate of claim 36, wherein the wheels include a front pair of wheels sharing a first common axis of rotation and a rear pair of wheels sharing a second common axis of rotation, such that each of the first common axis of rotation and the second common axis of rotation is disposed substantially beneath the primary foot support.

38. The skate of claim 37, wherein the foot rest is disposed above the reaction surface by a minimum vertical distance of at least 80 millimeters.

39. The skate of claim 36, further comprising a carrying tab extending from the main body, and including a hole configured to permit insertion of a human finger to effect support of the skate by the human finger.

40. The skate of claim 39, wherein the carrying tab is disposed rearwardly of the primary foot support and is configured for limiting rearward movement of the skater's foot when supported by and coupled to the primary foot support.

* * * * *